US010728677B2

(12) United States Patent
Pedersen et al.

(10) Patent No.: US 10,728,677 B2
(45) Date of Patent: Jul. 28, 2020

(54) HEARING DEVICE AND A BINAURAL HEARING SYSTEM COMPRISING A BINAURAL NOISE REDUCTION SYSTEM

(71) Applicant: Oticon A/S, Smørum (DK)

(72) Inventors: Michael Syskind Pedersen, Smørum (DK); Jesper Jensen, Smørum (DK)

(73) Assignee: OTICON A/S, Smørum (DK)

( * ) Notice: Subject to any disclaimer, the term of this patent is extended or adjusted under 35 U.S.C. 154(b) by 0 days.

(21) Appl. No.: 16/218,172

(22) Filed: Dec. 12, 2018

(65) Prior Publication Data

US 2019/0182607 A1 Jun. 13, 2019

(30) Foreign Application Priority Data

Dec. 13, 2017 (EP) ..... 17206888

(51) Int. Cl.
*H04R 25/00* (2006.01)
*H04R 3/00* (2006.01)

(52) U.S. Cl.
CPC ..... *H04R 25/552* (2013.01); *H04R 25/407* (2013.01); *H04R 25/554* (2013.01);
(Continued)

(58) Field of Classification Search
None
See application file for complete search history.

(56) References Cited

U.S. PATENT DOCUMENTS 8,204,263 B2 6/2012 Pedersen et al.
9,924,281 B2 3/2018 Pedersen et al.
(Continued)

FOREIGN PATENT DOCUMENTS

EP 2 431 973 A1 3/2012
EP 2 961 199 A1 12/2015
(Continued)

*Primary Examiner* — James K Mooney
(74) *Attorney, Agent, or Firm* — Birch, Stewart, Kolasch & Birch, LLP.

(57) ABSTRACT

The application relates to a hearing device, e.g. a hearing aid, adapted for being located at or in an ear of a user, or for being fully or partially implanted in the head of the user. The application further relates to a method of operating a hearing device. The hearing device comprises a) an input unit for providing at least one electric input signal in a frequency sub-band representation comprising a number K of frequency bands, b) a frequency band to channel allocation unit for allocating said K frequency bands to a number N of frequency channels for each of said electric input signals, wherein K>N; c) antenna and transceiver circuitry allowing reception of at least one further electric signal in said N frequency channels from another device, e.g. another hearing device, d) a first beamformer filtering unit for providing at least one channel beamformer based on said at least one electric input signal and said at least one further electric signal received from said other device, in said N frequency channels. The hearing device may further comprise a level to gain transformation unit for receiving said at least one channel beamformer and providing a post filter gain for each frequency channel in dependence thereof. The invention may e.g. be used in binaural hearing aid systems.

17 Claims, 10 Drawing Sheets

(52) U.S. Cl.
CPC ..... *H04R 3/005* (2013.01); *H04R 25/405* (2013.01); *H04R 2225/43* (2013.01); *H04R 2410/01* (2013.01); *H04R 2410/05* (2013.01); *H04R 2430/03* (2013.01)

(56) References Cited

U.S. PATENT DOCUMENTS

| | | | | |
|---|---|---|---|---|
| 2013/0188796 | A1* | 7/2013 | Kristensen ..... | H04R 25/453 381/60 |
| 2014/0286497 | A1* | 9/2014 | Thyssen ..... | H04R 3/005 381/66 |
| 2016/0119723 | A1* | 4/2016 | Galster ..... | H04R 25/453 381/315 |

FOREIGN PATENT DOCUMENTS

| | | | |
|---|---|---|---|
| EP | 3 016 408 | A1 | 5/2016 |
| EP | 3 116 239 | A1 | 1/2017 |
| EP | 3 160 162 | A1 | 4/2017 |
| EP | 3 229 490 | A1 | 10/2017 |
| EP | 3 255 634 | A1 | 12/2017 |
| WO | WO 2009/072040 | A1 | 6/2009 |

* cited by examiner

HEARING DEVICE AND A BINAURAL HEARING SYSTEM COMPRISING A BINAURAL NOISE REDUCTION SYSTEM

SUMMARY

The present disclosure deals with hearing devices, and with a binaural hearing system comprising first and second hearing devices, e.g. hearing aids, adapted for being located at or in left and right ears of a user. Embodiments of the present disclosure relates to spatial filtering and binaural exchange of data to provide binaural noise reduction.

Spatial processing, such as beamforming, is often applied in different bands across frequency, and processing may be performed independently in each band. In a typical hearing instrument, access to the sound from two closely-spaced microphones is provided. Having access to more than two microphones is desirable, because it allows narrower beams, hereby enabling attenuation of more background noise. Furthermore, a binaural microphone configuration allows an improved directivity towards the sides, where the local microphones (pointing in the front-back direction) has the optimal directivity towards the front or the back. An obvious choice for one or two extra microphones would be microphone(s) of a hearing instrument located at the opposite ear (of a binaural hearing aid system). Having access to microphone signals from this or these microphone(s) requires that the sound signals can be exchanged between the ears, e.g. wirelessly. A wireless transmission channel has a limited bit rate, i.e. the amount of data that can be exchanged between the two hearing aids is limited. This limited bit rate may not allow exchanging the full microphone signal(s) between the hearing aids, which is required for a traditional multi-microphone binaural beamformer. In the following, a scheme which tries to achieve the performance of a binaural beamformer, while exchanging less information between the hearing aids than normally required, is proposed. Thereby power consumption can be minimized.

A scheme for providing binaural noise reduction which does not require transmission of the whole audio signal is provided. The idea is to only transmit data in specific frequency channels from one hearing instrument to the other. A frequency channel could e.g. be the summed signal across different frequency bands in the complex frequency domain. When only a frequency channel consisting of summed bands is transmitted, a beamformer signal can still be obtained in the receiving hearing aid in that summed frequency channel. However, from that summed frequency channel beamformer signal, we cannot re-synthesize a useful time-domain signal. E.g. if we have K complex frequency bands, and the K bands are merged into N ($N<K$) channels, by combining some of the frequency bands, we have lost some information, and we cannot reconstruct the K bands solely from the N channels. Still, the information in the resulting binaural beamformer signal can be used to improve a single-channel noise reduction stage, which is typically executed after the beamformer stage. A linear phase filter bank designed to allow distortion free combination (e.g. summation) of frequency band signals to frequency channel signals is e.g. discussed in EP3229490A1.

Single-channel noise reduction algorithms typically require fast-varying estimates of the signal-to-noise-ratio (SNR) in each frequency channel. The SNR estimate is thus converted into a gain signal in the time-frequency domain, which then is multiplied to the noisy sound signal. The efficiency of the noise reduction gain depends on the accuracy of the local SNR estimate.

Spatial noise reduction techniques may be used to obtain the SNR estimate needed by the single-channel noise reduction. For example, the SNR estimate may be obtained by directing a beam towards the sound of interest, hereby cancelling as much noise as possible (signal estimate), and creating a beam which places a null towards the direction of the target sound, hereby cancelling the sound of interest (noise estimate), see e.g. U.S. Pat. No. 8,204,263. The quality of this signal to noise estimate will thus depend on the quality of the beamformer's ability to estimate the signal of interest and the noise. Alternatively, we may obtain an a posteriori SNR estimate, i.e. the squared ratio between the noisy mixture of target and noise and the noise estimate, from which the a priori SNR can be estimated (cf. e.g. EP3255634A1).

The received beamformer signal in the summed-frequency band described above, is the output of a beamformer with at least two or more than two microphones. Such a beamformer signal based on at least two or more than two microphone signals is potentially able to attenuate more background noise and consequently provide a better estimate of the SNR compared to what is possible with only two local microphones.

In the following, the terms 'channel beamformer' and 'channel beamformer signal' are used interchangeably, without any intended difference in meaning. The channel beamformer or channel beamformer signal is the result of a weighted combination of at least two input signals in a number of frequency channels N (or N1 or N2). The number of frequency channels N is smaller than the number of frequency bands K used in the processing of the electric input signals representing sound (e.g. from a number of microphones of a forward path of the hearing device), which after processing and conversion to a time domain signal is intended for being presented to a user as stimuli perceivable as sound via an output unit (e.g. a loudspeaker).

A Hearing Device:

In an aspect of the present application, a hearing device, e.g. a hearing aid, adapted for being located at or in an ear of a user, or for being fully or partially implanted in the head of the user is provided. The hearing device comprises,

- an input unit for providing at least one electric input signal representing sound in the environment of the user wearing the hearing device in a frequency sub-band representation comprising a number K of frequency bands,
- a frequency band to channel allocation unit for allocating said number K of frequency bands to a number N of frequency channels for said at least one electric input signal, wherein the number K of frequency bands is larger than the number N of frequency channels;
- antenna and transceiver circuitry allowing to receive at least one further electric signal representing sound in the environment of the user wearing the hearing device in said number N of frequency channels from another device, and
- a first beamformer filtering unit for providing at least one channel beamformer based on said at least one electric input signal in said number N of frequency channels and said at least one further electric signal received from said other device in said number N of frequency channels.

Thereby a hearing device with improved noise reduction may be provided.

The band allocation unit may be adaptive. Different allocation schemes may be stored in the instrument depending on the application.

The at least one channel beamformer may be a beamformer representative of noise in the environment, e.g. a target cancelling beamformer, the target cancelling beamformer representing noise signal components of the at least one (noisy) electric input signal.

In an embodiment, the antenna and transceiver circuitry is configured to transmit at least one of said at least one electric input signals, or a processed version thereof, in said number of frequency channels to another device, e.g. to said other device from which the further electric signal is received.

The hearing device may comprise a level to gain transformation unit for receiving said at least one channel beamformer and providing a post filter gain for each frequency channel in dependence of said channel beamformer. The post filter gain may be based on the at least one channel beamformer and said at least one electric input signal. The at least one channel beamformer may be a beamformer representative of noise in the environment, e.g. a target cancelling beamformer. The at least one channel beamformer may be provided as a combination of at least two electric input signals (in N frequency channels, N<K). The combination may be a linear combination using real or complex (e.g. frequency dependent) beamformer weights $w_p$, p=1, . . . P, where P is the number of electric input signal to the at least one channel beamformer.

The hearing device may comprise a channel to band distribution unit for distributing said post filter gains for each of said N channels to post filter gains for each of said K frequency bands. The K post filter gains may e.g. be configured to be applied (e.g. by a processor, e.g. comprising a combination unit (e.g. comprising respective multiplication units)) to a signal of the forward path of the hearing device to (further) reduce noise components in the signal.

The hearing device may comprise a processor for applying said post filter gains for each of said K frequency bands to said at least one electric input signal, or a signal originating therefrom (i.e. to a signal of the forward path of the hearing device, which is provided in K frequency bands), and providing a noise reduced signal in K frequency bands.

The first beamformer filtering unit may comprise first and second channel beamformers based on said at least one electric input signal in said number of frequency channels and at least one further signal in said number of frequency channels received from said other device. The first channel beamformer may represent a target maintaining beamformer (representing target signal components of the noisy input signal(s)). The second channel beamformer may represent a target cancelling beamformer (representing noise signal components of the at (noisy) electric input signal(s)).

The input unit may be configured to provide at least two electric input signals representing sound in the environment of the user wearing the hearing device in a frequency sub-band representation comprising a number K of frequency bands, and the hearing device further comprises a second beamformer filtering unit for receiving said at least two electric input signals in said number K of frequency bands and providing a beamformed signal in said number K of frequency bands. In an embodiment, the processor for applying the post filter gains is configured to apply the gains to the beamformed signal.

The input unit may be configured to provide at least two electric input signals representing sound in the environment of the user wearing the hearing device in a frequency sub-band representation comprising the number K of frequency bands, and the hearing device may further comprise at least two frequency band to channel allocation units (connected to the input unit) for allocating the number K of frequency bands to a number N1 of frequency channels for the at least two electric input signals, wherein the number K of frequency bands is larger than the number N1 of frequency channels (K>N1). The hearing device may further comprise at least two first beamformer filtering units,

- a first one for providing at least one local channel beamformer based on the at least two electric input signals in said number N1 of frequency channels, and
- a second one for providing at least one binaural channel beamformer based
  - on at least one of the at least two electric input signals in a number N2 of said number N1 of frequency channels, where N2 is smaller than or equal to N1, and
  - on the at least one further electric signal received from the other device in said number N2 of frequency channels.

The antenna and transceiver circuitry is configured to receive the least one further electric signal representing sound in the environment of the user wearing the hearing device in the number N2 (where N2<N1) of frequency channels from another device (e.g. another hearing device of a binaural hearing system). The N2 frequency channels are e.g. selected among the N1 frequency channels. The N2 frequency channels are e.g. selected among the N1 frequency channels with a view to providing relevant information about noise sources of the environment, and/or spatial cues. The N2 frequency channels may e.g. be the lowest lying frequency channels among the N1 frequency channels, i.e. cover a frequency range below a threshold frequency, e.g. 2 kHz.

The level to gain transformation unit may be configured to receive the at least one local channel beamformer and the at least one binaural channel beamformer and to provide the post filter gain for each frequency channel in dependence of the local and binaural channel beamformers.

However, in a specific local mode of operation of the hearing device, the level to gain transformation unit is configured to provide the post filter gain for each frequency channel in dependence of the local channel beamformer, while neglecting the binaural channel beamformer. A special local mode of operation of the hearing device may e.g. be entered in case the signal from the other device is not received (e.g. because the (e.g. wireless) communication link to the other device is not enabled, or because the link quality is degraded). The special local mode of operation may e.g. be activated (entered) in dependence of a link quality measure, or in dependence of a battery status signal. The special local mode of operation may e.g. be activated via a user interface, e.g. implemented in a portable device, e.g. as an APP of smartphone, or a similar device (e.g. a smartwatch or tablet computer).

The frequency band to channel allocation unit may comprise a number of band combination units, each configured to provide a—possibly weighted—combination of the contents of two or more of said K frequency bands and to provide a respective one of said N frequency channels. In an embodiment at least one frequency band is NOT combined with other frequency bands, but is provided as one of the frequency channels (i.e. such one of the N frequency channels consist of one of the K frequency bands). One or more of the lowest frequency bands (covering the lowest part of the operating frequency range of the hearing device) is/are provided as corresponding frequency channels (without being combined with other frequency bands). In an embodiment, one or more of the highest frequency bands (covering the highest part of the operating frequency range of the hearing device) is/are NOT provided as frequency channels (i.e. are not considered (i.e. are ignored) by the first beamformer filtering unit (and thus does not contribute to the first and second beamformers provided by the first beamformer filtering unit). In an embodiment, only frequency bands corresponding to a frequency range (or possibly separate ranges) containing speech components considered to be significant for the user's intelligibility of speech are provided as corresponding frequency channels. In an embodiment, only frequency bands corresponding to a frequency range from 0 to 4 kHz, such as from 0 to 3 kHz, such as from 1 kHz to 3 kHz, are provided as corresponding frequency channels.

In an embodiment, the number of band combination units comprises a band sum unit configured to provide a—possibly weighted—sum of the contents of two or more of said frequency bands and to provide a respective one of said frequency channels. In an embodiment, the weights are equal to 1, thereby implementing an algebraic sum of frequency bands. In an embodiment, at least two of the weights are different from one.

The frequency band to channel allocation unit may comprise a number of down-sampling units, each configured to down-sample a signal of a given one of the N channels with a down-sampling factor and to provide a corresponding down-sampled channel signal. In an embodiment, the down-sampled channel signals are sampled with a frequency smaller than 1 kHz, such as smaller than 600 Hz, e.g. in a range between 100 Hz and 200 Hz. The down-sampled channel signals may e.g. be used to be exchanged the other device, i.e. the hearing device may be configured to transmit the down-sampled channel signal to the other device, and to receive a corresponding down-sampled channel signal from the other device. The down-sampled signals may be used by the first beamformer filtering unit, instead of the corresponding original (not down-sampled) signal in N frequency bands. Thereby, bandwidth and/or power in a wireless link for exchanging frequency channels (e.g. representing one or more of the electric input signals, and/or combinations thereof, e.g. a resulting beamformed signal), can be decreased (minimized).

The hearing device may comprise a filter bank. In an embodiment, the filter bank comprises an analysis filter bank for transforming an input signal in the time domain to a number of frequency sub-band signals. For or a binaural hearing system comprising left and right hearing devices, the system is preferably configured to align time frames as well as sampling rates between the two devices. In an embodiment, the filter bank comprises a synthesis filter bank for transforming a number of frequency sub-band signals to an output signal in the time domain. In an embodiment, the input unit comprises a filter bank for each of the electric input signals to provide the respective electric input signals in a frequency sub-band representation comprising a number (K) of frequency bands. A linear phase filter bank designed to allow distortion free combination of frequency band signals is e.g. discussed in EP3229490A1. The filter bank(s) is(are) e.g. inserted in the forward path of the hearing device downstream of the input unit to provide each electric (time-domain) signal in K frequency bands. Thereby processing in the frequency domain is enabled (e.g. independently in K frequency bands in signal(s) of the forward path, and (when connected to appropriate band combination units) in N channels in signals of an analysis or processing path).

The number K of frequency bands of a signal of the forward path of the hearing device, i.e. the number of frequency sub-band signals that the time-domain input signal is split into, is e.g. larger than or equal to 16, such as larger than or equal to 64, such as larger than or equal to 128. The number N of frequency channels is smaller than the number of frequency bands K, e.g. smaller than or equal to 48, or smaller than or equal to 24, or smaller than or equal to 16, smaller than or equal to 8.

The level to gain transformation unit may comprise a signal quality estimator for estimating a signal quality measure in dependence of target and noise signal components at a given point in time. In an embodiment, the hearing device is configured to provide the signal quality measure, termed the SN-measure, in a time frequency framework, e.g. in some of or each of the K frequency bands or N frequency channels. In an embodiment, the signal quality estimator is configured to estimate a target signal to noise ratio (SNR), e.g. SNR(k',m), where k' and m are frequency and time (frame) indices, respectively. The level to gain transformation unit is configured to receive the channel beamformer signal(s) from the first beamformer filtering unit(s). The signal quality estimator is e.g. configured to estimate the signal quality measure on at least one (e.g. all) of the channel beamformer signals.

In an embodiment, the level to gain transformation unit is configured to provide said post filter gain values for each frequency channel in dependence of said signal quality measure or a smoothed version thereof. In an embodiment, the level to gain transformation unit is configured to provide said post filter gain values for each frequency channel in dependence of said signal quality measure (the SN-measure, e.g. the SNR) at a given point in time. A smoothed version of the signal quality measure may e.g. be averaged over a certain, e.g. predefined, number of previous time instances, e.g. time-frames.

The level to gain transformation unit is configured to provide said post filter gain values for each frequency channel in dependence of said signal quality measure. The level to gain transformation unit may e.g. be configured to provide the post filter gain values to implement a higher gain (lower attenuation) when the signal quality is high than when the signal quality is low (e.g. on a time-frequency unit (k',m) basis, where k' and m are frequency and time (frame) indices, respectively), e.g. keeping the post filter gain (attenuation) within upper and lower threshold values.

The hearing device may comprise an own voice detector configured to estimate the presence of the user's own voice at a specific point in time based on said at least one electric input signal in said number N of frequency channels and said at least one further signal in said number N of frequency channels received from said other device. The own voice detector may provide an own voice detection signal representative of a probability that a given one of the N frequency channels comprises the user's own voice at a given time. In an embodiment, the own voice detector (e.g. the at least one channel beamformer) comprises an own voice cancelling beamformer. In an embodiment, the own voice detector (e.g. the at least one channel beamformer) comprises an own voice maintaining beamformer. In an embodiment, the own voice detector is configured to pick up the user's own voice and/or to suppress other sounds in the environment than the user's voice, possibly to suppress only non-speech components other than the user's own voice. The user's own voice may in such mode e.g. be picked up and transmitted to another device, e.g. to a telephone. The own voice detection signal may, alternatively or additionally, be used to control a gain in the forward path of the hearing device (e.g. to lower gain when a user's own voice is detected).

The hearing device may comprise an output unit for providing a stimulus perceived by the user as an acoustic signal based on a processed electric signal. In an embodiment, the output unit comprises a number of electrodes of a cochlear implant or a vibrator of a bone conducting hearing device. In an embodiment, the output unit comprises an output transducer. In an embodiment, the output transducer comprises a receiver (loudspeaker) for providing the stimulus as an acoustic signal to the user. In an embodiment, the output transducer comprises a vibrator for providing the stimulus as mechanical vibration of a skull bone to the user (e.g. in a bone-attached or bone-anchored hearing device). The processed electric signal may e.g. be received from a processor of the forward path of the hearing device. The processed electric signal may e.g. be a signal of the forward path that has been subject to noise reduction according to the present disclosure. The processed electric signal may e.g. be a signal of the forward path that has been processed to compensate for a hearing impairment of the user (e.g. according to a hearing profile, e.g. comprising an audiogram, of the user).

The hearing device may comprise a hearing aid, a headset, an earphone, an ear protection device or a combination thereof.

'Another device' may be constituted by or comprise a hearing device or a separate processing device, e.g. a smartphone.

In an embodiment, the hearing device, e.g. a hearing aid, is adapted to provide a frequency dependent gain and/or a level dependent compression and/or a transposition (with or without frequency compression) of one or more frequency ranges to one or more other frequency ranges, e.g. to compensate for a hearing impairment of a user. In an embodiment, the hearing device comprises a signal processor for enhancing the input signals and providing a processed output signal.

In an embodiment, the hearing device comprises an output unit for providing a stimulus perceived by the user as an acoustic signal based on a processed electric signal. In an embodiment, the output unit comprises a number of electrodes of a cochlear implant or a vibrator of a bone conducting hearing device. In an embodiment, the output unit comprises an output transducer. In an embodiment, the output transducer comprises a receiver (loudspeaker) for providing the stimulus as an acoustic signal to the user. In an embodiment, the output transducer comprises a vibrator for providing the stimulus as mechanical vibration of a skull bone to the user (e.g. in a bone-attached or bone-anchored hearing device).

In an embodiment, the input unit comprises an input transducer, e.g. a microphone, for converting an input sound to an electric input signal. The input unit may comprise a microphone array providing a multitude (e.g. two or more) of electric input signals. In an embodiment, the input unit comprises a wireless receiver for receiving a wireless signal comprising sound and for providing an electric input signal representing said sound.

In hearing devices, a microphone array beamformer is often used for spatially attenuating background noise sources. In an embodiment, the beamformer filtering unit comprises a minimum variance distortionless response (MVDR) beamformer. Ideally, the MVDR beamformer keeps the signals from the target direction (also referred to as the look direction) unchanged, while attenuating sound signals from other directions maximally. The generalized sidelobe canceller (GSC) structure is an equivalent representation of the MVDR beamformer offering computational and numerical advantages over a direct implementation in its original form.

In an embodiment, the hearing device comprises an antenna and transceiver circuitry (e.g. a wireless receiver) for wirelessly receiving a direct electric input signal from another device, e.g. from an entertainment device (e.g. a TV-set), a communication device (e.g. a telephone), a wireless microphone, or another hearing device. In an embodiment, the direct electric input signal represents or comprises an audio signal and/or a control signal and/or an information signal. In an embodiment, the hearing device comprises demodulation circuitry for demodulating the received direct electric input to provide the direct electric input signal representing an audio signal and/or a control signal e.g. for setting an operational parameter (e.g. volume) and/or a processing parameter of the hearing device. In general, a wireless link established by antenna and transceiver circuitry of the hearing device can be of any type. In an embodiment, the wireless link is established between two devices, e.g. between an entertainment device (e.g. a TV) and the hearing device, or between two hearing devices, e.g. via a third, intermediate device (e.g. a processing device, such as a remote control device, a smartphone, etc.). In an embodiment, the wireless link is used under power constraints, e.g. in that the hearing device is or comprises a portable (typically battery driven) device. In an embodiment, the wireless link is a link based on near-field communication, e.g. an inductive link based on an inductive coupling between antenna coils of transmitter and receiver parts. In another embodiment, the wireless link is based on far-field, electromagnetic radiation. Preferably, communication between the hearing device and the other device is based on some sort of modulation at frequencies above 100 kHz. Preferably, frequencies used to establish a communication link between the hearing device and the other device is below 70 GHz, e.g. located in a range from 50 MHz to 70 GHz, e.g. above 300 MHz, e.g. in an ISM range above 300 MHz, e.g. in the 900 MHz range or in the 2.4 GHz range or in the 5.8 GHz range or in the 60 GHz range (ISM=Industrial, Scientific and Medical, such standardized ranges being e.g. defined by the International Telecommunication Union, ITU). In an embodiment, the wireless link is based on a standardized or proprietary technology. In an embodiment, the wireless link is based on Bluetooth technology (e.g. Bluetooth Low-Energy technology).

In an embodiment, the hearing device is a portable device, e.g. a device comprising a local energy source, e.g. a battery, e.g. a rechargeable battery.

In an embodiment, the hearing device comprises a forward or signal path between an input unit (e.g. an input transducer, such as a microphone or a microphone system and/or direct electric input (e.g. a wireless receiver)) and an output unit, e.g. an output transducer. In an embodiment, the signal processor is located in the forward path. In an embodiment, the signal processor is adapted to provide a frequency dependent gain according to a user's particular needs. In an embodiment, the hearing device comprises an analysis or control path comprising functional components for analyzing the input signal (e.g. determining a level, a modulation, a type of signal, an acoustic feedback estimate, etc.). In an embodiment, some or all signal processing of the analysis path and/or the signal path is conducted in the frequency domain. In an embodiment, some or all signal processing of the analysis path and/or the signal path is conducted in the time domain.

In an embodiment, an analogue electric signal representing an acoustic signal is converted to a digital audio signal in an analogue-to-digital (AD) conversion process, where the analogue signal is sampled with a predefined sampling frequency or rate $f_s$, $f_s$ being e.g. in the range from 8 kHz to 48 kHz (adapted to the particular needs of the application) to provide digital samples $x_n$ (or x[n]) at discrete points in time $t_n$ (or n), each audio sample representing the value of the acoustic signal at $t_n$ by a predefined number $N_b$ of bits, $N_b$ being e.g. in the range from 1 to 48 bits, e.g. 24 bits. Each audio sample is hence quantized using $N_b$ bits (resulting in $2^{Nb}$ different possible values of the audio sample). A digital sample x has a length in time of $1/f_s$, e.g. 50 μs, for $f_s$=20 kHz. In an embodiment, a number of audio samples are arranged in a time frame. In an embodiment, a time frame comprises 64 or 128 audio data samples. Other frame lengths may be used depending on the practical application.

In an embodiment, the hearing devices comprise an analogue-to-digital (AD) converter to digitize an analogue input (e.g. from an input transducer, such as a microphone) with a predefined sampling rate, e.g. larger than or equal to 16 kHz, such as larger than or equal to 20 kHz (e.g. 24 kHz, or 25 kHz). In an embodiment, the hearing devices comprise a digital-to-analogue (DA) converter to convert a digital signal to an analogue output signal, e.g. for being presented to a user via an output transducer.

In an embodiment, the hearing device, e.g. the microphone unit, and or the transceiver unit comprise(s) a TF-conversion unit for providing a time-frequency representation of an input signal. In an embodiment, the time-frequency representation comprises an array or map of corresponding complex or real values of the signal in question in a particular time and frequency range. In an embodiment, the TF conversion unit comprises a filter bank for filtering a (time varying) input signal and providing a number of (time varying) output signals each comprising a distinct frequency range of the input signal. In an embodiment, the TF conversion unit comprises a Fourier transformation unit for converting a time variant input signal to a (time variant) signal in the (time-)frequency domain. In an embodiment, the frequency range considered by the hearing device from a minimum frequency $f_{min}$ to a maximum frequency $f_{max}$ comprises a part of the typical human audible frequency range from 20 Hz to 20 kHz, e.g. a part of the range from 20 Hz to 12 kHz. Depending on the purpose, we may choose a smaller range of frequencies, e.g. for different detectors. Typically, a sample rate $f_s$ is larger than or equal to twice the maximum frequency $f_{max}$, $f_s \geq 2f_{max}$. In an embodiment, a signal of the forward and/or analysis path of the hearing device is split into a number NI of frequency bands (e.g. of uniform width), where N1 is e.g. larger than 5, such as larger than 10, such as larger than 50, such as larger than 100, such as larger than 500, at least some of which are processed individually. In an embodiment, the hearing device is/are adapted to process a signal of the forward and/or analysis path in a number NP of different frequency channels (NP≤NI). The frequency channels may be uniform or non-uniform in width (e.g. increasing in width with frequency), overlapping or non-overlapping.

In an embodiment, the hearing device comprises a number of detectors configured to provide status signals relating to a current physical environment of the hearing device (e.g. the current acoustic environment), and/or to a current state of the user wearing the hearing device, and/or to a current state or mode of operation of the hearing device. Alternatively or additionally, one or more detectors may form part of an external device in communication (e.g. wirelessly) with the hearing device. An external device may e.g. comprise another hearing device, a remote control, and audio delivery device, a telephone (e.g. a Smartphone), an external sensor, etc.

In an embodiment, one or more of the number of detectors operate(s) on the full band signal (time domain). In an embodiment, one or more of the number of detectors operate(s) on band split signals ((time-) frequency domain), e.g. in a limited number of frequency bands.

In an embodiment, the number of detectors comprises a level detector for estimating a current level of a signal of the forward path. In an embodiment, the predefined criterion comprises whether the current level of a signal of the forward path is above or below a given (L-)threshold value. In an embodiment, the level detector operates on the full band signal (time domain). In an embodiment, the level detector operates on band split signals ((time-) frequency domain).

In a particular embodiment, the hearing device comprises a voice detector (VD) for estimating whether or not (or with what probability) an input signal comprises a voice signal (at a given point in time). A voice signal is in the present context taken to include a speech signal from a human being. It may also include other forms of utterances generated by the human speech system (e.g. singing). In an embodiment, the voice detector unit is adapted to classify a current acoustic environment of the user as a VOICE or NO-VOICE environment. This has the advantage that time segments of the electric microphone signal comprising human utterances (e.g. speech) in the user's environment can be identified, and thus separated from time segments only (or mainly) comprising other sound sources (e.g. artificially generated noise). In an embodiment, the voice detector is adapted to detect as a VOICE also the user's own voice. Alternatively, the voice detector is adapted to exclude a user's own voice from the detection of a VOICE.

In an embodiment, the hearing device comprises an own voice detector for estimating whether or not (or with what probability) a given input sound (e.g. a voice, e.g. speech) originates from the voice of the user of the system. In an embodiment, a microphone system of the hearing device is adapted to be able to differentiate between a user's own voice and another person's voice and possibly from NON-voice sounds. Own voice may be detected from the exchanged signals from the combined frequency channels. It is advantageous to detect own voice from a combination of both of the local microphones, which have different distances to the mouth and the binaural microphones, which approximately have the same distance to the mouth. The signals used for own voice detection (or other directions of arrival) can easily be combined across frequency bands as well as down-sampled (even more than critically down-sampled).

In an embodiment, the number of detectors comprises a movement detector, e.g. an acceleration sensor. In an embodiment, the movement detector is configured to detect movement of the user's facial muscles and/or bones, e.g. due to speech or chewing (e.g. jaw movement) and to provide a detector signal indicative thereof.

In an embodiment, the hearing device further comprises other relevant functionality for the application in question, e.g. compression, feedback cancellation, noise reduction, etc.

In an embodiment, the hearing device comprises a listening device, e.g. a hearing aid, e.g. a hearing instrument, e.g. a hearing instrument adapted for being located at the ear or fully or partially in the ear canal of a user, e.g. a headset, an earphone, an ear protection device or a combination thereof.

A Binaural Own Voice Detector:

In an aspect of the present application, a binaural own voice detector, e.g. for a hearing device, such as a hearing aid, is provided. The binaural own voice detector is adapted to be worn by a user and comprises, first and second ear pieces adapted for being located at left and right ears of the user, each ear piece comprising an input unit for providing at least one electric input signal representing sound in the environment of the user wearing the hearing device in a frequency sub-band representation comprising a number K of frequency bands, a frequency band to channel allocation unit for allocating said number K of frequency bands to a number N of frequency channels for said at least one electric input signal, wherein the number K of frequency bands is larger than the number N of frequency channels;

antenna and transceiver circuitry allowing to receive at least one further electric signal representing sound in the environment of the user wearing the hearing device in said number N of frequency channels from another device, and an own voice detector for providing an own voice detection signal based on said at least one electric input signal in said number N of frequency channels and said at least one further electric signal received from said other device in said number N of frequency channels.

In an embodiment, the own voice detector comprises a first beamformer filtering unit for providing at least one channel beamformer based on said at least one electric input signal in said number of frequency channels and said at least one further electric signal received from said other device in said number of frequency channels. The at least one channel beamformer may comprise an own voice cancelling beamformer for estimating noise in the at least one electric input signal (noise being e.g. defined as components not originating from the user's own voice). The binaural voice detector may e.g. form part of a (binaural) hearing system according to the present disclosure.

Use:

In an aspect, use of a hearing device as described above, in the 'detailed description of embodiments' and in the claims, is moreover provided. In an embodiment, use is provided in a system comprising audio distribution, e.g. a system comprising a microphone, a signal processor, and a loudspeaker. In an embodiment, use is provided in a system comprising one or more hearing aids (e.g. hearing instruments), headsets, ear phones, active ear protection systems, etc., e.g. in handsfree telephone systems, teleconferencing systems, public address systems, karaoke systems, classroom amplification systems, etc.

A Method:

In an aspect, a method of operating a hearing device, e.g. a hearing aid, adapted for being located at or in an ear of a user, or for being fully or partially implanted in the head of the user is furthermore provided by the present application. The method comprises providing at least one electric input signal representing sound in the environment of the user wearing the hearing device in a frequency sub-band representation comprising a number K of frequency bands, allocating said number K of frequency bands to a number N of frequency channels for said at least one electric input signal, wherein the number K of frequency bands is larger than the number N of frequency channels;

receiving at least one further electric signal representing sound in the environment of the user wearing the hearing device in said number N of frequency channels from another device, and providing at least one channel beamformer based on said at least one electric input signal in said number N of frequency channels and said at least one further electric signal received from said other device in said number N of frequency channels.

It is intended that some or all of the structural features of the hearing device described above, in the 'detailed description of embodiments' or in the claims can be combined with embodiments of the method, when appropriately substituted by a corresponding process and vice versa. Embodiments of the method have the same advantages as the corresponding devices.

The at least one channel beamformer may be a beamformer representative of noise in the environment, e.g. a target cancelling beamformer, the target cancelling beamformer representing noise signal components of the at least one (noisy) electric input signal.

In an embodiment, the method comprises transmitting at least one of said at least one electric input signals, or a processed version thereof, in said number of frequency channels to another device, e.g. to said other device from which the further electric signal is received.

In an embodiment, the method comprises providing a post filter gain for each frequency channel in dependence of said channel beamformer. The post filter gain may be based on the at least one channel beamformer and said at least one electric input signal. The at least one channel beamformer may be a beamformer representative of noise in the environment, e.g. a target cancelling beamformer.

In an embodiment, the method comprises distributing said post filter gains for each of said N channels to post filter gains for each of said K frequency bands. In an embodiment, the method comprises applying said post filter gains for each of said K frequency bands to said at least one electric input signal, or a signal originating therefrom, and providing a noise reduced signal in K frequency bands.

In an embodiment, the method comprises providing first and second channel beamformers based on said at least one electric input signal in said number of frequency channels and said at least one further signal in said number of frequency channels received from said other device. The first channel beamformer may represent a target maintaining beamformer (representing target signal components of the noisy input signal(s)). The second channel beamformer may represent a target cancelling beamformer (representing noise signal components of the at (noisy) electric input signal(s)).

In an embodiment, the method comprises providing at least two electric input signals representing sound in the environment of the user wearing the hearing device in a frequency sub-band representation comprising a number K of frequency bands, and providing a beamformed signal in said number K of frequency bands based on said at least two electric input signals in said number K of frequency bands.

In an embodiment, the method comprises applying the post filter gains to the beamformed signal.

A Computer Readable Medium:

In an aspect, a tangible computer-readable medium storing a computer program comprising program code means for causing a data processing system to perform at least some (such as a majority or all) of the steps of the method described above, in the 'detailed description of embodiments' and in the claims, when said computer program is executed on the data processing system is furthermore provided by the present application.

By way of example, and not limitation, such computer-readable media can comprise RAM, ROM, EEPROM, CD-ROM or other optical disk storage, magnetic disk storage or other magnetic storage devices, or any other medium that can be used to carry or store desired program code in the form of instructions or data structures and that can be accessed by a computer. Disk and disc, as used herein, includes compact disc (CD), laser disc, optical disc, digital versatile disc (DVD), floppy disk and Blu-ray disc where disks usually reproduce data magnetically, while discs reproduce data optically with lasers. Combinations of the above should also be included within the scope of computer-readable media. In addition to being stored on a tangible medium, the computer program can also be transmitted via a transmission medium such as a wired or wireless link or a network, e.g. the Internet, and loaded into a data processing system for being executed at a location different from that of the tangible medium.

A Computer Program:

A computer program (product) comprising instructions which, when the program is executed by a computer, cause the computer to carry out (steps of) the method described above, in the 'detailed description of embodiments' and in the claims is furthermore provided by the present application.

A Data Processing System:

In an aspect, a data processing system comprising a processor and program code means for causing the processor to perform at least some (such as a majority or all) of the steps of the method described above, in the 'detailed description of embodiments' and in the claims is furthermore provided by the present application.

A Hearing System:

In a further aspect, a hearing system comprising a hearing device as described above, in the 'detailed description of embodiments', and in the claims, AND an auxiliary device is moreover provided.

In an embodiment, the auxiliary device is or comprises another hearing device. In an embodiment, the hearing system comprises two hearing devices adapted to implement a binaural hearing system, e.g. a binaural hearing aid system.

In an embodiment, the hearing system is adapted to establish a communication link between the hearing device and the auxiliary device to provide that information (e.g. control and status signals, possibly audio signals) can be exchanged or forwarded from one to the other.

In an embodiment, the hearing system comprises an auxiliary device, e.g. a remote control, a smartphone, or other portable or wearable electronic device, such as a smartwatch or the like.

In an embodiment, one of the hearing devices is configured to receive only. In an embodiment, the system comprises first and second hearing devices, wherein one of the hearing devices (e.g. the first) is configured to (only) receive a further electric signal from the other (the second) hearing device, and the second hearing device is configured to (only) transmit a further electric signal to the first hearing device. In such embodiment, the channel beamformer (and e.g. possible post filter gains) can be applied only in one of the hearing devices (here the first). In an embodiment, the system is configured to transmit and or receive to/from the auxiliary device to allow a microphone of the auxiliary to be used by the system and/or to perform part of the processing in the auxiliary device, or to allow the auxiliary device to perform the function of an intermediate (e.g. relay) device.

The hearing system may comprise a remote control. In an embodiment, the auxiliary device is constituted by or comprises a remote control, or a smartphone, or another portable or wearable electronic device, such as a smartwatch or the like.

The hearing system may comprise first and second hearing devices each as described above, in the 'detailed description of embodiments', and in the claims. The first and second hearing devices may be adapted to be mounted at or in, or fully or partially implemented in the head at, left and right ears, respectively, of the user, and constituting or forming part of a binaural hearing system. The hearing system may be implemented as a binaural hearing system.

In an embodiment, the auxiliary device is or comprises a remote control for controlling functionality and operation of the hearing device(s). In an embodiment, the function of a remote control is implemented in a SmartPhone, the SmartPhone possibly running an APP allowing to control the functionality of the audio processing device via the SmartPhone (the hearing device(s) comprising an appropriate wireless interface to the SmartPhone, e.g. based on Bluetooth or some other standardized or proprietary scheme).

In an embodiment, the auxiliary device is or comprises an audio gateway device adapted for receiving a multitude of audio signals (e.g. from an entertainment device, e.g. a TV or a music player, a telephone apparatus, e.g. a mobile telephone or a computer, e.g. a PC) and adapted for selecting and/or combining an appropriate one of the received audio signals (or combination of signals) for transmission to the hearing device.

An APP:

In a further aspect, a non-transitory application, termed an APP, is furthermore provided by the present disclosure. The APP comprises executable instructions configured to be executed on an auxiliary device to implement a user interface for a hearing device or a hearing system described above in the 'detailed description of embodiments', and in the claims. In an embodiment, the APP is configured to run on cellular phone, e.g. a smartphone, or on another portable device allowing communication with said hearing device or said hearing system.

Definitions

In the present context, a 'hearing device' refers to a device, such as a hearing aid, e.g. a hearing instrument, or an active ear-protection device, or other audio processing device, which is adapted to improve, augment and/or protect the hearing capability of a user by receiving acoustic signals from the user's surroundings, generating corresponding audio signals, possibly modifying the audio signals and providing the possibly modified audio signals as audible signals to at least one of the user's ears. A 'hearing device' further refers to a device such as an earphone or a headset adapted to receive audio signals electronically, possibly modifying the audio signals and providing the possibly modified audio signals as audible signals to at least one of the user's ears. Such audible signals may e.g. be provided in the form of acoustic signals radiated into the user's outer ears, acoustic signals transferred as mechanical vibrations to the user's inner ears through the bone structure of the user's head and/or through parts of the middle ear as well as electric signals transferred directly or indirectly to the cochlear nerve of the user.

The hearing device may be configured to be worn in any known way, e.g. as a unit arranged behind the ear with a tube leading radiated acoustic signals into the ear canal or with an output transducer, e.g. a loudspeaker, arranged close to or in the ear canal, as a unit entirely or partly arranged in the pinna and/or in the ear canal, as a unit, e.g. a vibrator, attached to a fixture implanted into the skull bone, as an attachable, or entirely or partly implanted, unit, etc. The hearing device may comprise a single unit or several units communicating electronically with each other. The loudspeaker may be arranged in a housing together with other components of the hearing device, or may be an external unit in itself (possibly in combination with a flexible guiding element, e.g. a dome-like element).

More generally, a hearing device comprises an input transducer for receiving an acoustic signal from a user's surroundings and providing a corresponding input audio signal and/or a receiver for electronically (i.e. wired or wirelessly) receiving an input audio signal, a (typically configurable) signal processing circuit (e.g. a signal processor, e.g. comprising a configurable (programmable) processor, e.g. a digital signal processor) for processing the input audio signal and an output unit for providing an audible signal to the user in dependence on the processed audio signal. The signal processor may be adapted to process the input signal in the time domain or in a number of frequency bands. In some hearing devices, an amplifier and/or compressor may constitute the signal processing circuit. The signal processing circuit typically comprises one or more (integrated or separate) memory elements for executing programs and/or for storing parameters used (or potentially used) in the processing and/or for storing information relevant for the function of the hearing device and/or for storing information (e.g. processed information, e.g. provided by the signal processing circuit), e.g. for use in connection with an interface to a user and/or an interface to a programming device. In some hearing devices, the output unit may comprise an output transducer, such as e.g. a loudspeaker for providing an air-borne acoustic signal or a vibrator for providing a structure-borne or liquid-borne acoustic signal. In some hearing devices, the output unit may comprise one or more output electrodes for providing electric signals (e.g. a multi-electrode array for electrically stimulating the cochlear nerve).

In some hearing devices, the vibrator may be adapted to provide a structure-borne acoustic signal transcutaneously or percutaneously to the skull bone. In some hearing devices, the vibrator may be implanted in the middle ear and/or in the inner ear. In some hearing devices, the vibrator may be adapted to provide a structure-borne acoustic signal to a middle-ear bone and/or to the cochlea. In some hearing devices, the vibrator may be adapted to provide a liquid-borne acoustic signal to the cochlear liquid, e.g. through the oval window. In some hearing devices, the output electrodes may be implanted in the cochlea or on the inside of the skull bone and may be adapted to provide the electric signals to the hair cells of the cochlea, to one or more hearing nerves, to the auditory brainstem, to the auditory midbrain, to the auditory cortex and/or to other parts of the cerebral cortex.

A hearing device, e.g. a hearing aid, may be adapted to a particular user's needs, e.g. a hearing impairment. A configurable signal processing circuit of the hearing device may be adapted to apply a frequency and level dependent compressive amplification of an input signal. A customized frequency and level dependent gain (amplification or compression) may be determined in a fitting process by a fitting system based on a user's hearing data, e.g. an audiogram, using a fitting rationale (e.g. adapted to speech). The frequency and level dependent gain may e.g. be embodied in processing parameters, e.g. uploaded to the hearing device via an interface to a programming device (fitting system), and used by a processing algorithm executed by the configurable signal processing circuit of the hearing device.

A 'hearing system' refers to a system comprising one or two hearing devices, and a 'binaural hearing system' refers to a system comprising two hearing devices and being adapted to cooperatively provide audible signals to both of the user's ears. Hearing systems or binaural hearing systems may further comprise one or more 'auxiliary devices', which communicate with the hearing device(s) and affect and/or benefit from the function of the hearing device(s). Auxiliary devices may be e.g. remote controls, audio gateway devices, mobile phones (e.g. SmartPhones), or music players. Hearing devices, hearing systems or binaural hearing systems may e.g. be used for compensating for a hearing-impaired person's loss of hearing capability, augmenting or protecting a normal-hearing person's hearing capability and/or conveying electronic audio signals to a person. Hearing devices or hearing systems may e.g. form part of or interact with public-address systems, active ear protection systems, handsfree telephone systems, car audio systems, entertainment (e.g. karaoke) systems, teleconferencing systems, classroom amplification systems, etc.

Embodiments of the disclosure may e.g. be useful in applications such as binaural hearing aid systems, or other audio processing systems comprising two or more spatially separated body worn devices (e.g. a hearing device and a smartphone, or a smartwatch, or similar device), which each comprises an input sound transducer whose electric output is used in a multi-input noise reduction system.

BRIEF DESCRIPTION OF DRAWINGS

The aspects of the disclosure may be best understood from the following detailed description taken in conjunction with the accompanying figures. The figures are schematic and simplified for clarity, and they just show details to improve the understanding of the claims, while other details are left out. Throughout, the same reference numerals are used for identical or corresponding parts. The individual features of each aspect may each be combined with any or all features of the other aspects. These and other aspects, features and/or technical effect will be apparent from and elucidated with reference to the illustrations described hereinafter in which:

The figures are schematic and simplified for clarity, and they just show details which are essential to the understanding of the disclosure, while other details are left out. Throughout, the same reference signs are used for identical or corresponding parts.

Further scope of applicability of the present disclosure will become apparent from the detailed description given hereinafter. However, it should be understood that the detailed description and specific examples, while indicating preferred embodiments of the disclosure, are given by way of illustration only. Other embodiments may become apparent to those skilled in the art from the following detailed description.

DETAILED DESCRIPTION OF EMBODIMENTS

The detailed description set forth below in connection with the appended drawings is intended as a description of various configurations. The detailed description includes specific details for the purpose of providing a thorough understanding of various concepts. However, it will be apparent to those skilled in the art that these concepts may be practiced without these specific details. Several aspects of the apparatus and methods are described by various blocks, functional units, modules, components, circuits, steps, processes, algorithms, etc. (collectively referred to as "elements"). Depending upon particular application, design constraints or other reasons, these elements may be implemented using electronic hardware, computer program, or any combination thereof.

The electronic hardware may include microprocessors, microcontrollers, digital signal processors (DSPs), field programmable gate arrays (FPGAs), programmable logic devices (PLDs), gated logic, discrete hardware circuits, and other suitable hardware configured to perform the various functionality described throughout this disclosure. Computer program shall be construed broadly to mean instructions, instruction sets, code, code segments, program code, programs, subprograms, software modules, applications, software applications, software packages, routines, subroutines, objects, executables, threads of execution, procedures, functions, etc., whether referred to as software, firmware, middleware, microcode, hardware description language, or otherwise.

The present application relates to the field of hearing devices, e.g. hearing aids.

Figure 1:
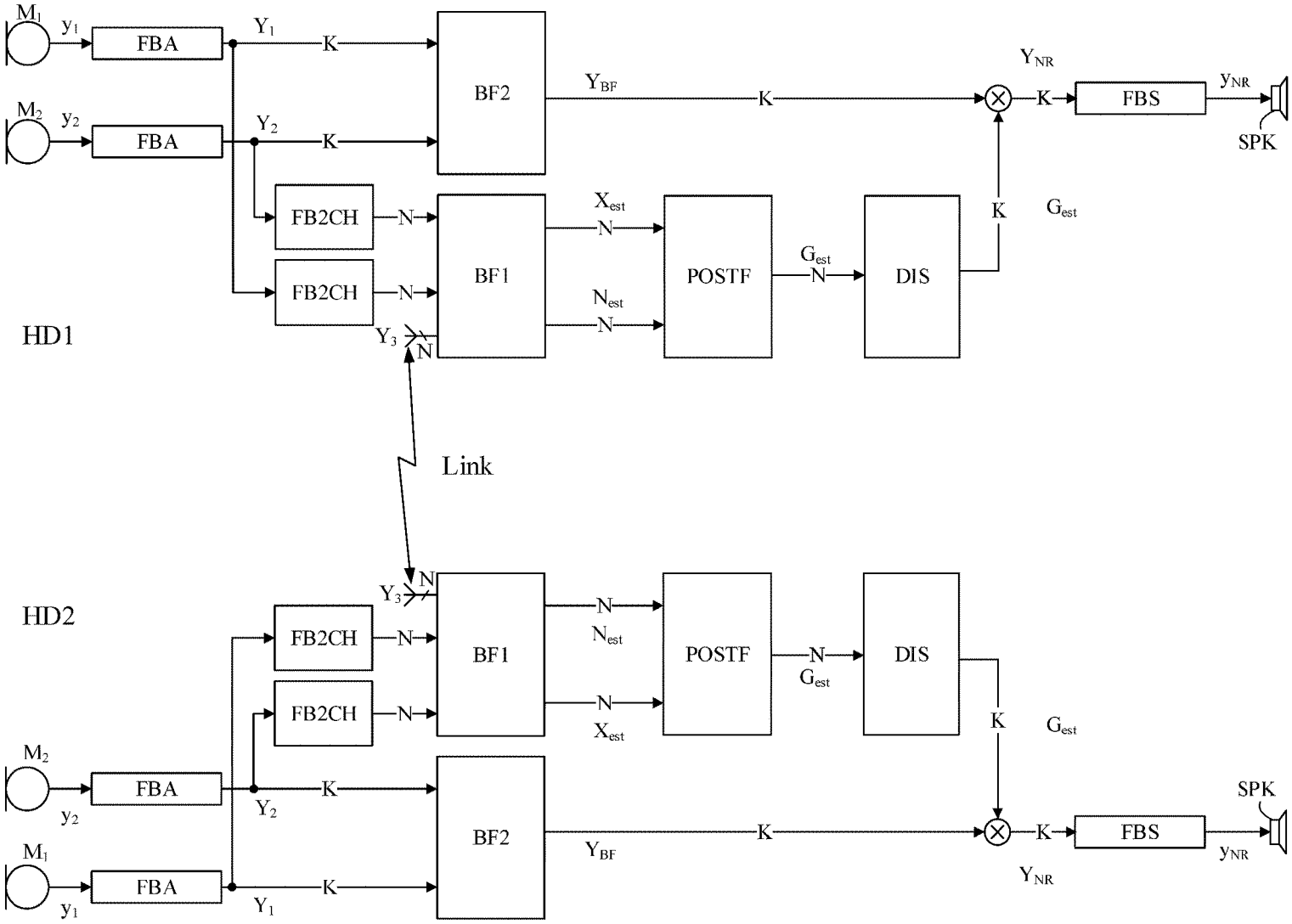
FIG. 1 shows a binaural hearing system according to an embodiment of the present disclosure.

FIG. 1 shows a binaural hearing system according to an embodiment of the present disclosure. FIG. 1 shows a binaural hearing system comprising first and second hearing devices (HD1, HD2), e.g. hearing aids, adapted for being located at or in left and right ears of a user, or for being fully or partially implanted in the head of the user (e.g. at left and right ears of a user). Each of the first and second hearing devices comprises an input unit (here comprising respective first and second microphones ($M_1$, $M_2$) and first and second analysis filter banks (FBA)) for providing first and second electric input signals $y_1$, $y_2$ representing sound in the environment of the user wearing the hearing device in a frequency sub-band representation $Y_1$, $Y_2$ comprising a number K of frequency bands. Each of the first and second hearing devices further comprises a frequency band to channel allocation unit (FB2CH) for allocating the K frequency bands to a number N of frequency channels for each of the first and second electric input signals $Y_1$, $Y_2$, wherein the number of frequency bands K is larger than the number of frequency channels N. Each of the first and second hearing devices further comprises antenna and transceiver circuitry (cf. antenna symbol at the beamformer filtering unit BF1) allowing to establish a wireless link (Link) between the first and second hearing devices (HD1, HD2) and the exchange of at least one of the electric input signals $Y_1$, $Y_2$, or a processed version thereof, in N frequency channels, with the other hearing device of the binaural hearing system. Each of the first and second hearing devices further comprises a first beamformer filtering unit (BF1) for providing first and second channel beamformers ($X_{est}$, $N_{est}$) based on said at least two electric input signals $Y_1$, $Y_2$ and at least one further signal (termed $Y_3$) in said number N of frequency channels. The at least one further signal is received from the contralateral hearing device (e.g. via an intermediate device, e.g. a remote control, or a smartphone). The first channel beamformer $X_{est}$ may e.g. represent a target maintaining beamformer (representing target signal components of the noisy input signals $Y_1$, $Y_2$). The second channel beamformer $N_{est}$ may e.g. represent a target cancelling beamformer (representing noise signal components of the at least two (noisy) electric input signals $Y_1$, $Y_2$). Each of the first and second hearing devices further comprises a level to gain transformation unit (here post-filter POSTF) for receiving the first and second channel beamformers ($X_{est}$, $N_{est}$) and providing a post filter gain $G_{est}$ for each frequency channel N in dependence of said first and second channel beamformers ($X_{est}$, $N_{est}$). Each of the first and second hearing devices further comprises a channel to band distribution unit (DIS) for distributing said post filter gains $G_{est}$ for each of said N channel to post filter gains $G_{est}$ for each of said K frequency bands. Each of the first and second hearing devices further comprises a second beamformer filtering unit (BF2) for receiving the first and second electric input signals $Y_1$, $Y_2$ and providing a beamformed signal $Y_{BF}$ in K frequency bands. Each of the first and second hearing devices further comprises a processor ('x') for applying the post filter gains $G_{est}$ for each of the K frequency bands to the beamformed signal $Y_{BF}$ and providing noise reduced signal $Y_{NR}$ in K frequency bands. Each of the first and second hearing devices further comprises a synthesis filter bank (FBS) for transforming a number of frequency sub-band signals of noise reduced signal $Y_{NR}$ (or a further processed version thereof, e.g. provided with appropriate gain or attenuation to compensate for a user's hearing impairment) to an output signal $y_{NR}$ in the time domain. Each of the first and second hearing devices further comprises an output unit (here an output transducer in the form of a loudspeaker (SPK) for providing the stimuli representing the output signal $y_{NR}$ as an acoustic signal to the user.

FIG. 1 illustrates an example of how a binaural beamformer may be used to estimate a signal to noise ratio on the receiving side and converted into a gain estimate (which may be used in a single-channel noise reduction context). The analysis filter bank (FBA) converts the time domain signals ($y_1$, $y_2$ of each of the hearing devices HD1 and HD2, respectively) into K different (possibly complex) frequency bands. The two local microphones ($M_1$, $M_2$) are used to create a directional signal $Y_{BF}$ based on all K frequency bands (by second beamformer filtering unit BF2). The K frequency bands may as well be converted into a fewer number of N channels (see also FIG. 2). Having the K frequency bands represented by a fewer number of N frequency channels requires less bits for binaural transmission (cf. wireless link (Link)) compared to transmitting a signal based a full frequency band representation. The wirelessly received microphone signal ($Y_3$) may together with the local microphone signals ($Y_1$, $Y_2$) in each channel (N) be used to create directional signals $X_{est}$, $N_{est}$ (in beamformer filtering unit BF1) being able to attenuating the noise (estimate of the source of interest, $X_{est}$) as well as being able to attenuate the source of interest (noise estimate $N_{est}$). The estimate of the source of interest, $X_{est}$, and the noise, Nest, enables us to find a local signal-to-noise-ratio (SNR), which may be converted into a gain $G_{est}$ (in post-filter POSTF) aiming at attenuating the noise while maintaining the target part of the sound. The gain may be distributed from the N channels onto K frequency bands (in channel to band distribution unit DIS, see also FIG. 2), before the gain $G_{est}$ is multiplied by the local directional signal $Y_{BF}$. The resulting signal $Y_{NR}$ is synthesized into an enhanced time domain signal $y_{NR}$, which is presented to the listener via loudspeaker SPK. FIG. 1 illustrates an example on how a signal representing different frequency channels is transmitted from one hearing instrument (HD1) to the other hearing instrument (HD2), and how the signal ($Y_3$) is used to obtain improved estimates of the signal of interest ($X_{est}$) as well as the noise ($N_{est}$). This, in turn, may lead to an improved local (per time-frequency tile) SNR estimate, which is improved compared to only using the local microphones for the SNR estimate. This improved local SNR estimate may e.g. be used to achieve improved performance in a single-channel noise reduction system (providing and applying improved gains $G_{est}$).

Figure 2:
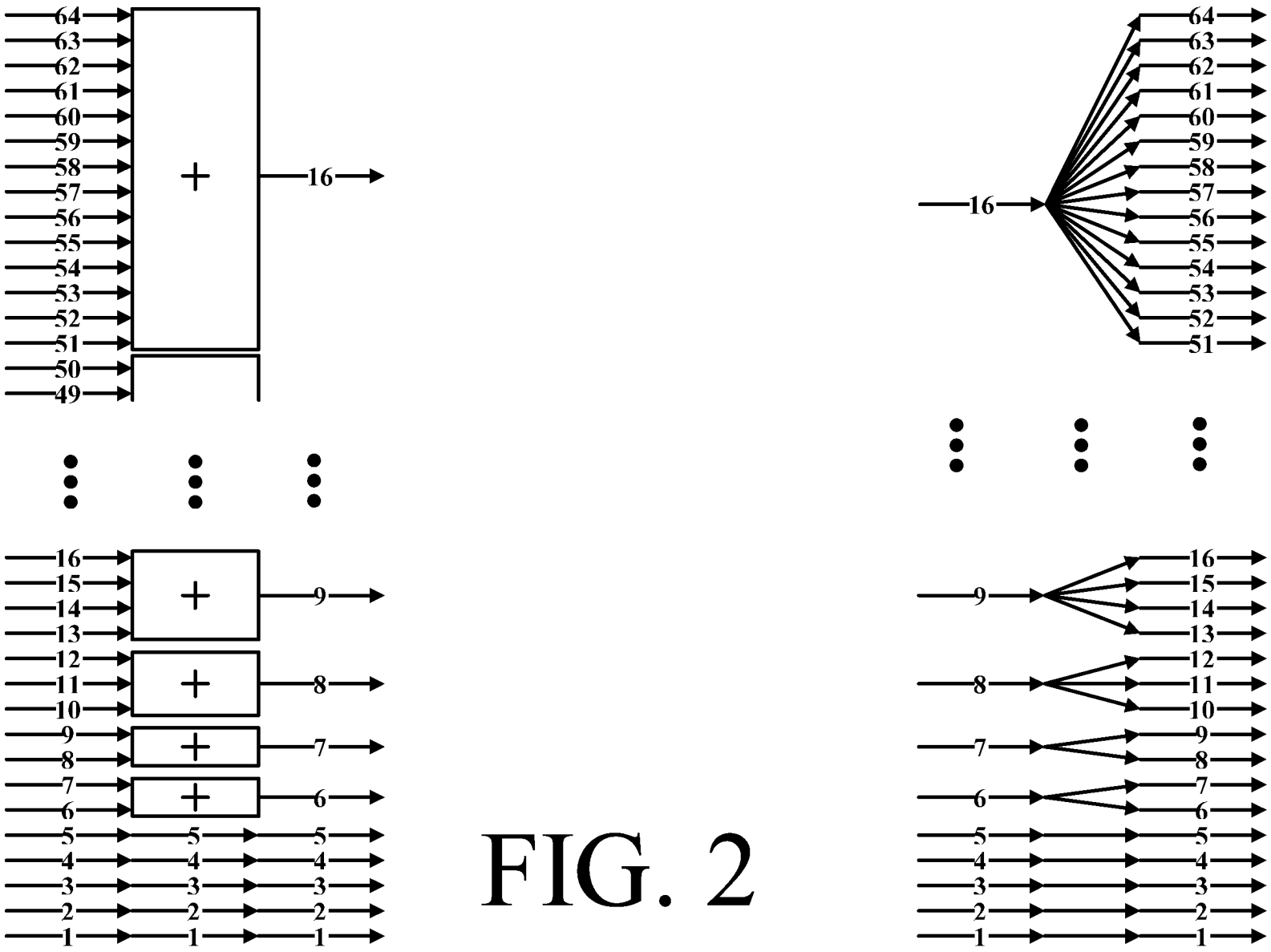
FIG. 2 shows an exemplary scheme for allocating frequency bands to frequency channels and for distributing frequency channels to frequency bands according to the present disclosure.

The transmitted signal ($Y_3$) will consist of up to N frequency channels representing up to K frequency bands (each frequency channel is constructed from one or more frequency bands, cf. e.g. FIG. 2), so N<=K). We may choose to transmit all N channels or a subset of the N channels (e.g. a subset of channels in the frequency region of most interest with respect to speech intelligibility, e.g. from 0 to 3 kHz). The single-channel noise reduction gain estimate $G_{est}$ could, in some frequency channels, be based on both microphones from both hearing instruments, in other frequency channels, the gain estimate $G_{est}$ may only depend on the local microphone signals. The wireless signal may be transmitted in both directions (exchanged), or the wireless signal may be only transmitted in one direction, e.g. choosing the transmission direction depending on the local signal to noise ratio estimate (see e.g. EP3116239A1). We may choose to transmit frequency channels from one of the microphone signals, from both of the microphone signals or from a directional signal obtained from a combination of the microphone signals. In some of the frequency channels, which consist of only a single frequency band (such as the first five bands in FIG. 2), we may choose also to create a directional signal based on all available microphones, which are used in the synthesized output. In general, when we have combined frequency bands, we cannot directly synthesize the signal into the time domain. Binaural beamforming will often reduce the spatial perception of the resulting signal, as we will add signals from both the hearing instrument at the left and the right ear. According to the present disclosure, the directional signal is generally based on the microphone signals in a single hearing instrument, but the gain is binaurally estimated (based on signals from both hearing instruments). Thereby, the binaural noise reduction method according to the present disclosure will have less tendency to deteriorate the spatial perception of the processed sound, while providing an improved noise suppression.

FIG. 2 shows an exemplary scheme for allocating frequency bands to frequency channels and for distributing frequency channels to frequency bands according to the present disclosure. The left side of FIG. 2 illustrates how a frequency domain signal consisting of K=64 (possibly complex) frequency bands may be combined into fewer channels, e.g. N=16 channels. The frequency resolution in the channels may be highest in the low frequencies, where the bands are not necessarily combined (added). As the frequency increases, more and more frequency bands may be merged into a single frequency channel. Hereby, the frequency resolution of the human ear is better mimicked. The combined frequency channels may be obtained simply by adding frequency bands together. Alternatively, frequency channels may be provided as a weighted sum of frequency bands, or frequency channels may represent overlapping frequency bands. The right side of FIG. 2 shows how the estimated gains of the 16 frequency channels correspondingly may be distributed back into frequency bands (e.g. be allocating each of the frequency bands from which a given frequency channel has been generated the same (possibly complex) value as the frequency channel in question).

Figure 3:
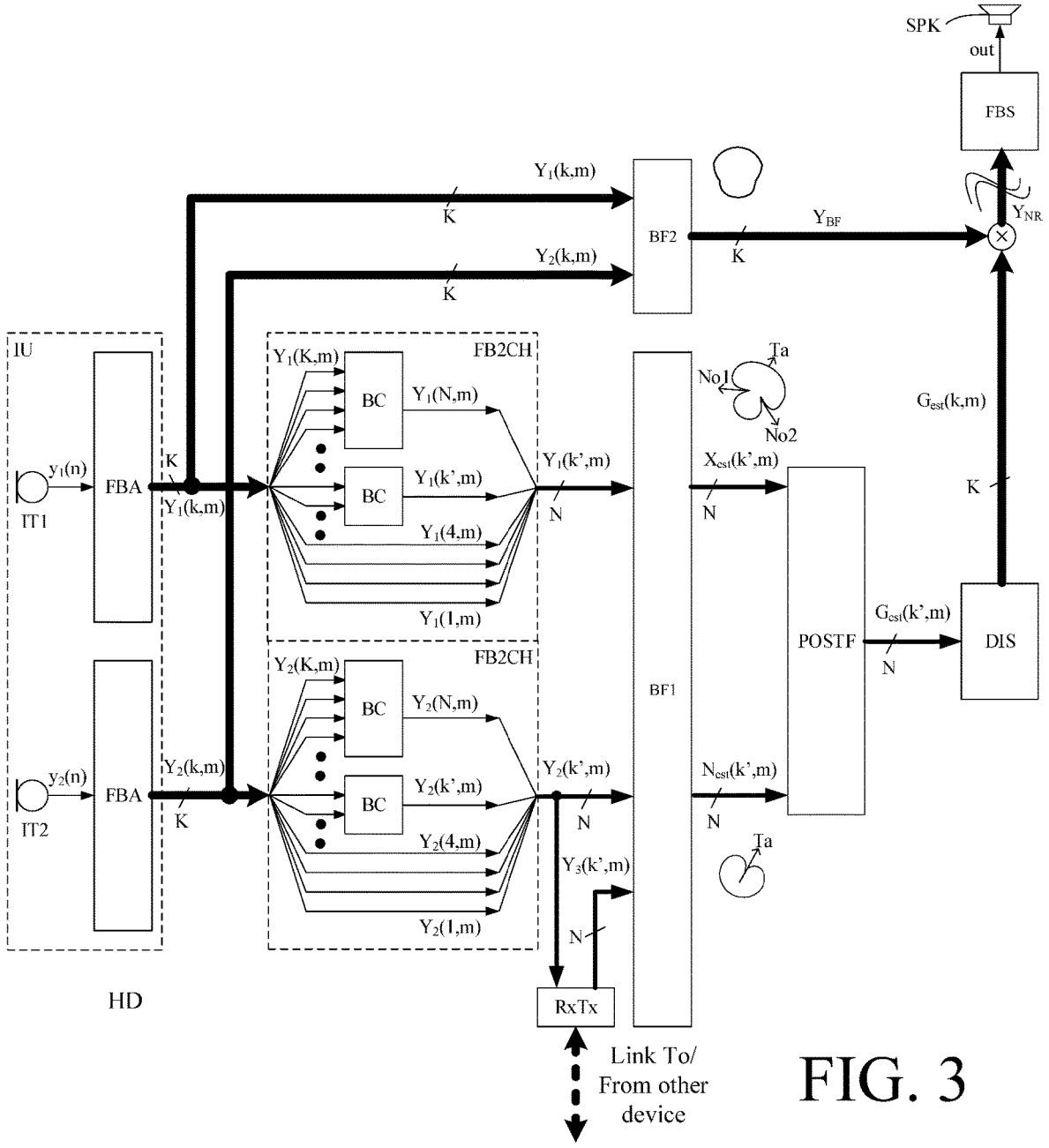
FIG. 3 shows a hearing device according to a first embodiment of the present disclosure.

FIG. 3 shows a hearing device according to a first embodiment of the present disclosure. The hearing device (HD) of FIG. 3 comprises the same functional components as each of the first and second hearing devices (HD1, HD2) of the embodiment of a binaural hearing system shown in FIG. 1 and discussed above. In the embodiment of FIG. 3, each of the first and second frequency band to channel allocation units (FB2CH) for allocating the K frequency bands of the first and second electric input signals $Y_1(k,m)$, $Y_2(k,m)$ (k=1, . . . , K) to a N of frequency channels (wherein K is larger than N), thereby providing the first and second electric input signals $Y_1(k',m)$, $Y_2(k',m)$ (k'=1, . . . , N), are shown in more detail. Each of the frequency band to channel allocation units (FB2CH) comprises a number of band combination units (BC), each configured to provide a—possibly weighted—combination of the contents of two or more of the frequency bands (k,m) and to provide a respective one of the frequency channels (k',m). In the embodiment of FIG. 3, the 4 lowest frequency bands ($Y_i(1,m)$, $Y_i(2,m)$, $Y_i(3,m)$, $Y_i(4,m)$, i=1, 2) are not combined with other frequency bands, but is provided as one of the frequency channels directly (i.e. NOT subject to a band combination unit). In the embodiment of FIG. 3, the highest lying frequency bands (covering the highest part of the operating frequency range of the hearing device) are combined to frequency channels via band combination units (BC). Alternatively, only the middle frequency bands (covering a middle part of the operating frequency range of the hearing device) are combined to frequency channels via band combination units (BC), whereas the highest frequency bands (covering the highest part of the operating frequency range of the hearing device) is/are NOT provided as frequency channels (i.e. are not considered (i.e. ignored) by the first beamformer filtering unit (BF1, and thus do not contribute to the first and second beamformers provided by the first beamformer filtering unit (BF1)). In an embodiment, only frequency bands corresponding to a frequency range (or possibly separate ranges) containing speech components considered to be significant for the user's intelligibility of speech are provided as corresponding frequency channels. In an embodiment, only frequency bands corresponding to a frequency range of 0 to 3 kHz, such as 1 kHz to 3 kHz, are provided as corresponding frequency channels. Thereby bandwidth and/or power can be saved in the hearing device (or hearing system).

As in FIG. 1 the first beamformer filtering unit (BF1) provides a target maintaining beamformer $X_{est}(k',m)$ and a target cancelling beamformer ($N_{est}(k',m)$) based on local electric input signals $Y_1(k',m)$, $Y_2(k',m)$, and received signal $Y_3(k',m)$ (k'=1, N) representing sound from the environment picked up by (and possibly processed in) a spatially separate other device (e.g. a contralateral hearing device, or a body worn audio processing device, a smartphone) via a wireless link and appropriate antenna and transceiver circuitry (RxTx). The first target maintaining beamformer is schematically illustrated above the beamformer name $X_{est}(k',m)$ comprises two independently adjustable minima (providing relatively large attenuation) corresponding to two independent noise source directions (No1, No2). The second target cancelling beamformer is schematically illustrated below the beamformer name $N_{est}(k',m)$ comprises a single minimum in the direction (Ta) of the target signal (but may have a more complex angle dependence as the case may be). The noise reduced signal $Y_{NR}(k,m)$ (k=1, K) may be further processed, e.g. subject to a compressive amplification algorithm before being converted to the time domain (in synthesis filter bank FBS) and the resulting signal out presented to the user via loudspeaker (SPK). The compressive amplification algorithm may e.g. be configured to the user's hearing profile, e.g. to a hearing impairment of the user, and adapted to compensate for such hearing impairment as far as possible.

Figure 4:
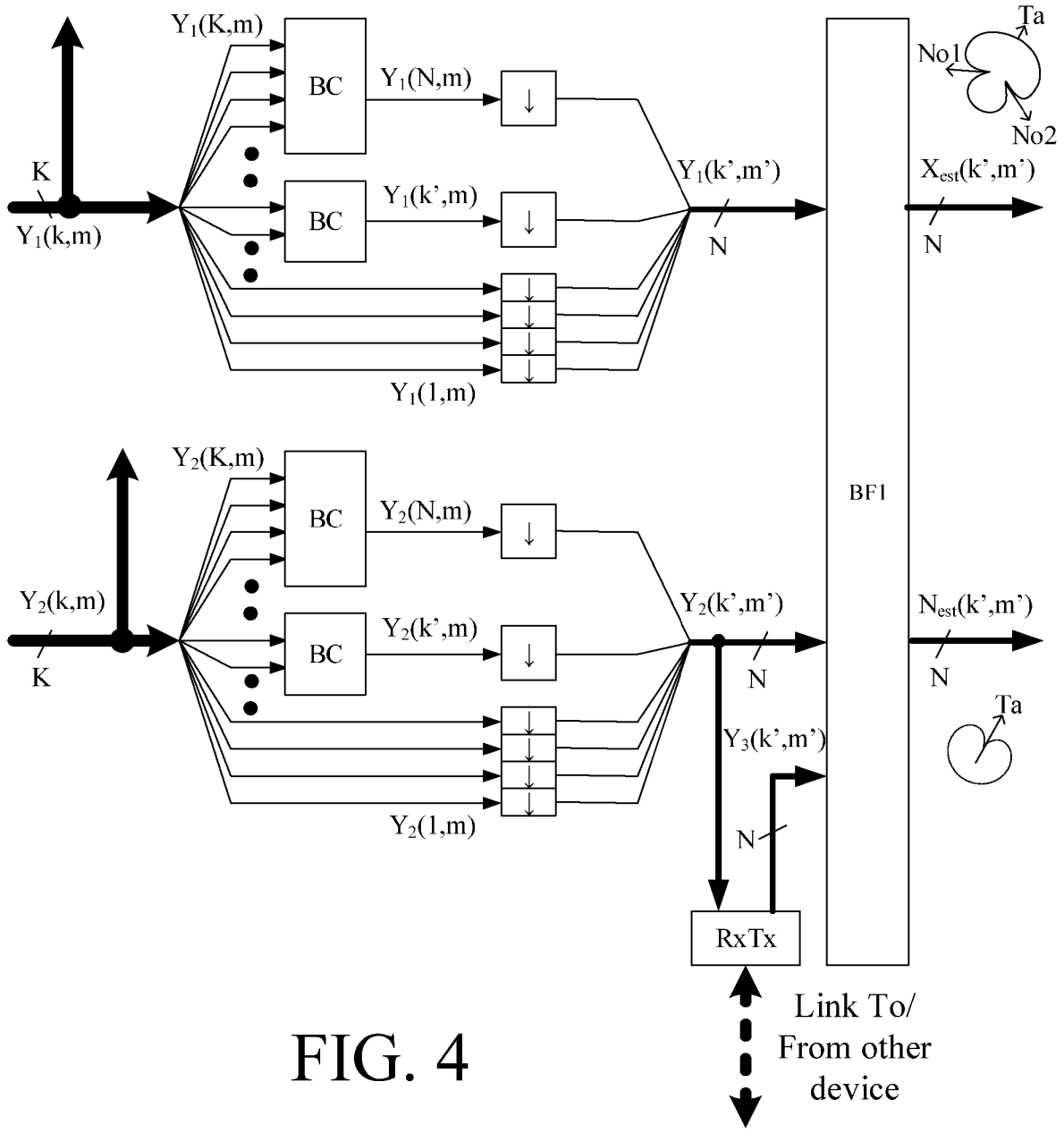
FIG. 4 shows a part of a hearing device comprising a frequency band to channel allocation unit and a first beamformer filtering unit for providing first and second beamformers according to an embodiment of the present disclosure, FIG. 5 schematically shows a time frequency representation of an electric input signal as a map of time frequency band based tiles (k,m) and frequency channel based units (k',m), where k and k' are frequency band and channel indices, and m is a time index, respectively.

FIG. 4 shows a part of a hearing device comprising a frequency band to channel allocation unit and a first beamformer filtering unit for providing first and second beamformers according to an embodiment of the present disclosure. The part of a hearing device illustrated in FIG. 4 comprises the same functional components as the corresponding part shown in FIG. 3 and discussed above. Additionally, each of the channel signals $Y_i(k',m)$ (k'=1, . . . , N, i=1, 2) are down-sampled by respective down-sampling units (denoted ↓ in FIG. 4) to provide down-sampled first and second electric input signals $Y_1(k',m')$, $Y_2(k',m')$ (k'=1, . . . , N). As we do not reconstruct the signal, the down-sampling rate can be higher than critical down-sampling. In an embodiment, the down-sampled channel signals are sampled in a range between 100 Hz and 200 Hz (corresponding to down-sampling factors D, wherein 100≤D≤200; wherein the interpretation of D will depend on the sample rate). Thereby, bandwidth and/or power in a wireless link for exchanging frequency channels (e.g. representing one or more of the electric input signals, and/or combinations thereof, e.g. a resulting beamformed signal), can be decreased (minimized). It is correspondingly assumed that the signal $Y_3$ received from the other device is similarly down-sampled and provided in corresponding frequency channels k' and time instances m'. The first beamformer (BF1) consequently provides the first and second channel beamformers $X_{est}(k',m')$, $N_{est}(k',m')$ based on the first and second down-sampled electric input signals and the further signal received from the other device, $Y_1(k',m')$, $Y_2(k',m')$, $Y_3(k',m')$ in N frequency channels (k'=1, . . . , N). The resulting estimated gains from the post filter when provided in K frequency bands $G_{est}(k,m')$ are consequently less resolved in time than in the embodiment, where no down-sampling is performed. It is, however, an advantage that power consumption and/or bandwidth is saved in the wireless link.

Figure 5:
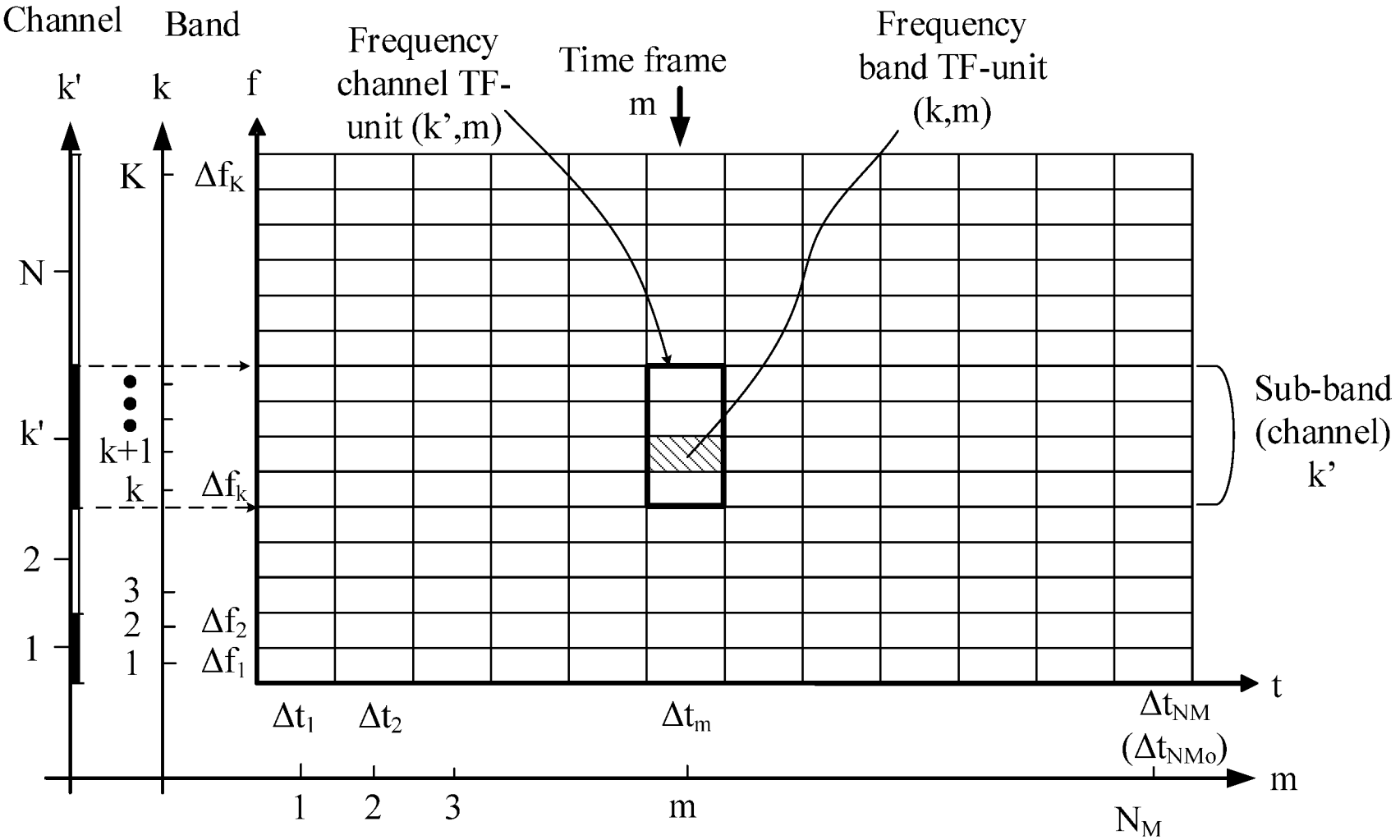

FIG. 5 schematically shows a time frequency representation of an electric input signal of as a map of time frequency band based tiles (k,m) and frequency channel based units (k',m), where k and k' are frequency band and channel indices, and m is a time index, respectively. The time-frequency representation comprises an array or map of corresponding complex or real values of the signal in a particular time and frequency range. The time-frequency representation (or frequency (sub-)band representation) may e.g. be a result of a Fourier transformation converting the time variant input signal y(n) to a (time variant) signal Y(k,m) in the time-frequency domain. In an embodiment, the Fourier transformation comprises a discrete Fourier transform algorithm (DFT), e.g. a short-time Fourier transform algorithm (STFT). The frequency range considered by a typical hearing aid (e.g. a hearing aid) from a minimum frequency $f_{min}$ to a maximum frequency $f_{max}$ comprises a part of the typical human audible frequency range from 20 Hz to 20 kHz, e.g. a part of the range from 20 Hz to 12 kHz. In FIG. 5, the time-frequency representation Y(k,m) of signal y(n) comprises complex values of magnitude and/or phase of the signal in a number of DFT-bins (or tiles) defined by indices (k,m), where K represents a number K of frequency values (cf. vertical k-axis in FIG. 5) and m=1, . . . , $N_M$ represents a number $N_M$ of time frames (cf. horizontal m-axis in FIG. 5). A time frame is defined by a specific time index m and the corresponding K DFT-bins (cf. indication of Time frame m in FIG. 5). A time frame m represents a frequency spectrum of signal y at time m. A DFT-bin or tile (k,m) comprising a (real) or complex value Y(k,m) of the signal in question is illustrated in FIG. 5 by hatching of the corresponding field in the time-frequency map (denoted Frequency band TF-unit (k,m)). Each value of the frequency index k corresponds to a frequency range $\Delta f_k$, as indicated in FIG. 5 by the vertical frequency axis f. Each value of the time index m represents a time frame. The time $\Delta t_m$ spanned by consecutive time indices depends on the length of a time frame and the degree of overlap between neighbouring time frames (cf. horizontal t-axis in FIG. 5).

In the leftmost axis of FIG. 5, a number N of (non-uniform) frequency channels with channel indices k'=1, 2, . . . , N is defined, each channel comprising one or more DFT-bins (cf. vertical Channel k'-axis in FIG. 5). The $k'^{th}$ channel (indicated by Sub-band (channel) k') in the right part of FIG. 5) comprises a number of DFT-bins (or tiles). A specific time-frequency unit (k',m) is defined by a specific time index m and a number of DFT-bin indices, as indicated in FIG. 5 by the bold framing around the corresponding DFT-bins (or tiles) (denoted Frequency channel TF-unit (k',m)). A specific time-frequency unit (k',m) contains complex or real values of the $k'^{th}$ channel signal Y(k',m) at time m. In an embodiment, the frequency channels represent one-third octave bands. In an embodiment, K=64 and N=16 as illustrated in FIG. 2.

The two frequency index scales k and k' represent two different levels of frequency resolution (a first, higher (index k), and a second, lower (index k') frequency resolution). The two frequency scales may e.g. be used for processing in different parts of the hearing device. In an embodiment, the higher resolution ('frequency bands') is used in a forward path (the audio signal path) that is intended for being presented to the user for audio perception. In an embodiment, the lower resolution ('frequency channels') is used in a control part of the hearing aid, e.g. for analysing a signal of the forward path and providing control signals for a processor of the forward path (e.g. providing gains for a noise reduction algorithm, cf. e.g. FIG. 1, 3).

Figure 6:
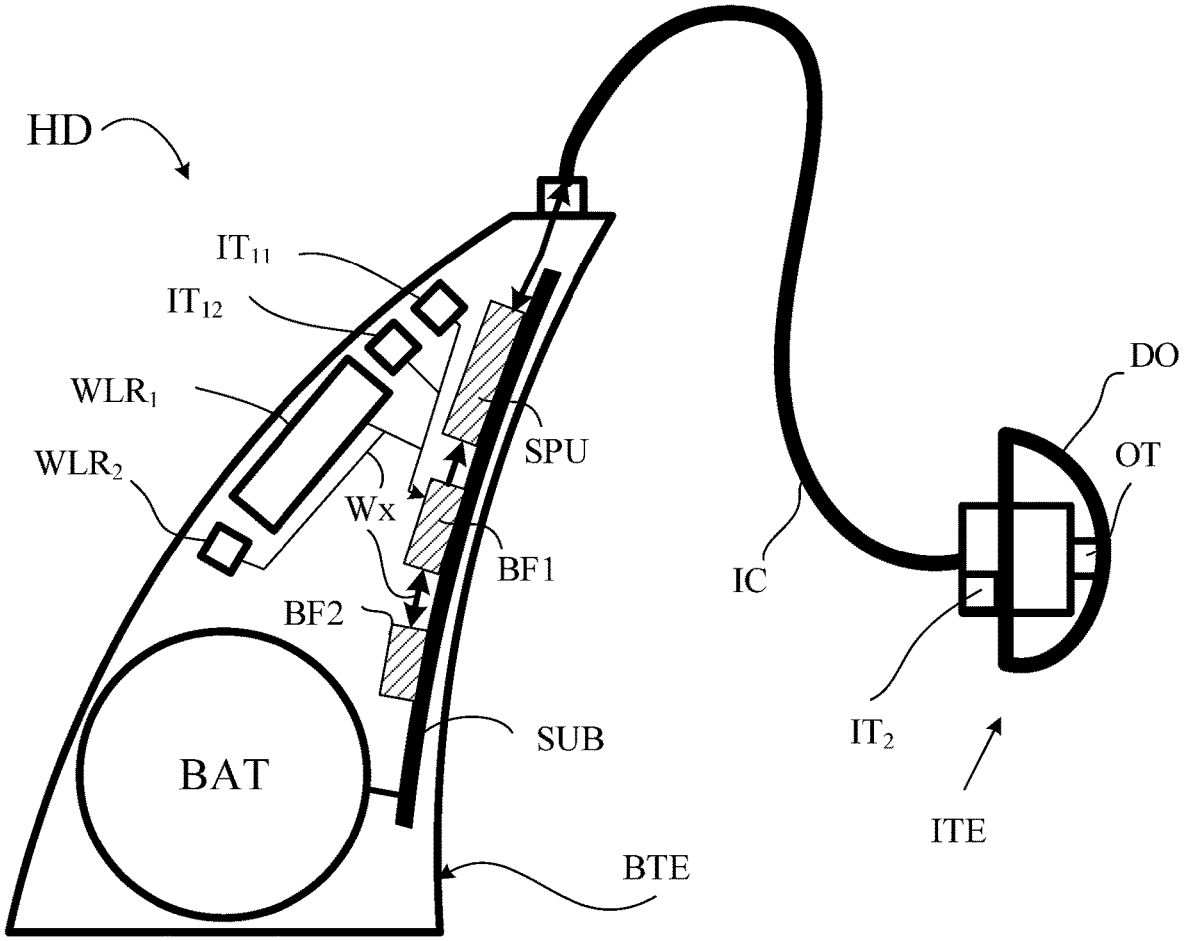
FIG. 6 shows an embodiment of a hearing device according to the present disclosure.

FIG. 6 shows an embodiment of a hearing device according to the present disclosure. The hearing device (HD) comprises a BTE-part (BTE) adapted for being located behind pinna and a part (ITE) adapted for being located in an ear canal of the user. The ITE-part may, as shown in FIG. 6, comprise an output transducer (e.g. a loudspeaker/receiver) adapted for being located in an ear canal of the user and to provide an acoustic signal (providing, or contributing to, an acoustic signal at the ear drum). In the latter case, a so-called receiver-in-the-ear (RITE) type hearing aid is provided. The BTE-part (BTE) and the ITE-part (ITE) are connected (e.g. electrically connected) by a connecting element (IC), e.g. comprising a number of electric conductors. Electric conductors of the connecting element (IC) may e.g. have the purpose of transferring electrical signals from the BTE-part to the ITE-part, e.g. comprising audio signals to the output transducer, and/or for functioning as antenna for providing a wireless interface. The BTE part (BTE) comprises an input unit comprising two input transducers (e.g. microphones) ($IT_{11}$, $IT_{12}$) each for providing an electric input audio signal representative of an input sound signal from the environment. The hearing aid (HD) of FIG. 6 further comprises two wireless transceivers ($WLR_1$, $WLR_2$) for transmitting and/or receiving respective audio and/or information signals and/or control signals (including one or more audio signals (e.g. in (possibly down-sampled) frequency channels (k'=1, . . . N) from a contra-lateral hearing device or an auxiliary device). The hearing aid (HD) further comprises a substrate (SUB) whereon a number of electronic components are mounted, functionally partitioned according to the application in question (analogue, digital, passive components, etc.), but including a configurable signal processor (SPU), e.g. comprising a processor for executing a number of processing algorithms, e.g. to compensate for a hearing loss of a wearer of the hearing device), first and second beamformer filtering units (BF1, BF2) for providing beamformed signals according to the present disclosure. The various components of the hearing device are coupled to each other and to input and output transducers and wireless transceivers via electrical conductors Wx. Typically, a front end IC for interfacing to the input and output transducers, etc. is further included on the substrate. The mentioned functional units (as well as other components) may be partitioned in circuits and components according to the application in question (e.g. with a view to size, power consumption, analogue vs. digital processing, etc.), e.g. integrated in one or more integrated circuits, or as a combination of one or more integrated circuits and one or more separate electronic components (e.g. inductor, capacitor, etc.). The configurable signal processor (SPU) provides a processed audio signal, which is intended to be presented to a user. In the embodiment of a hearing device in FIG. 6, the ITE part (ITE) comprises an input transducer (e.g. a microphone) ($IT_2$) for providing an electric input audio signal representative of an input sound signal from the environment at or in the ear canal. In another embodiment, the hearing aid may comprise only the BTE-microphones ($IT_{11}$, $IT_{12}$). In another embodiment, the hearing aid may comprise only the ITE-microphone ($IT_2$). In yet another embodiment, the hearing aid may comprise an input unit located elsewhere than at the ear canal in combination with one or more input units located in the BTE-part and/or the ITE-part. Band coupled signals may as well be transmitted from other devices, e.g. from a wireless microphone, e.g. in a smartphone or a similar device. The ITE-part may further comprise a guiding element, e.g. a dome (DO) or equivalent, for guiding and positioning the ITE-part in the ear canal of the user.

The hearing aid (HD) exemplified in FIG. 6 is a portable device and further comprises a battery, e.g. a rechargeable battery, (BAT) for energizing electronic components of the BTE- and possibly of the ITE-parts.

In an embodiment, the hearing device (HD) of FIG. 6, e.g. a hearing aid, form part of a hearing system according to the present disclosure, e.g. a binaural bearing system, e.g. a binaural hearing aid system comprising first and second hearing devices as shown in FIG. 6.

The hearing aid (HD) comprises first and second beamformer filtering units (BF1, BF2) adapted to spatially filter out a target acoustic source among a multitude of acoustic sources in the local environment of the user wearing the hearing aid, and to suppress 'noise' from other sources in the environment according to the present disclosure. The second beamformer filtering unit (BF2) may receive as inputs the respective electric signals from input transducers $IT_{11}$, $IT_{12}$, $IT_2$ (and possibly further input transducers) (or any combination thereof) and generate a beamformed signal ($Y_{BF}$ in FIG. 1, 3) based thereon. The first beamformer filtering unit (BF2) may receive as inputs the respective electric signals from input transducers $IT_{11}$, $IT_{12}$, $IT_2$ and further one or more signals from another device, e.g. a contralateral hearing device or a smartphone, and provide first and second beamformers for use in a post filter (POSTF in FIG. 1, 3) to provide gains ($G_{est}$ in FIG. 1, 3) applied to the beamformed signal $Y_{BF}$. In an embodiment, the beam former filtering unit is adapted to receive inputs from a user interface (e.g. a remote control or a smartphone) regarding the present target direction. A memory unit (MEM) may e.g. comprise predefined (or adaptively determined) complex, frequency dependent constants ($W_{ij}$) defining predefined (or adaptively determined) or 'fixed' beam patterns (e.g. omni-directional, target cancelling, pointing in a number of specific directions relative to the user), together defining a beamformed signal $Y_{BF}$.

Figure 7A:
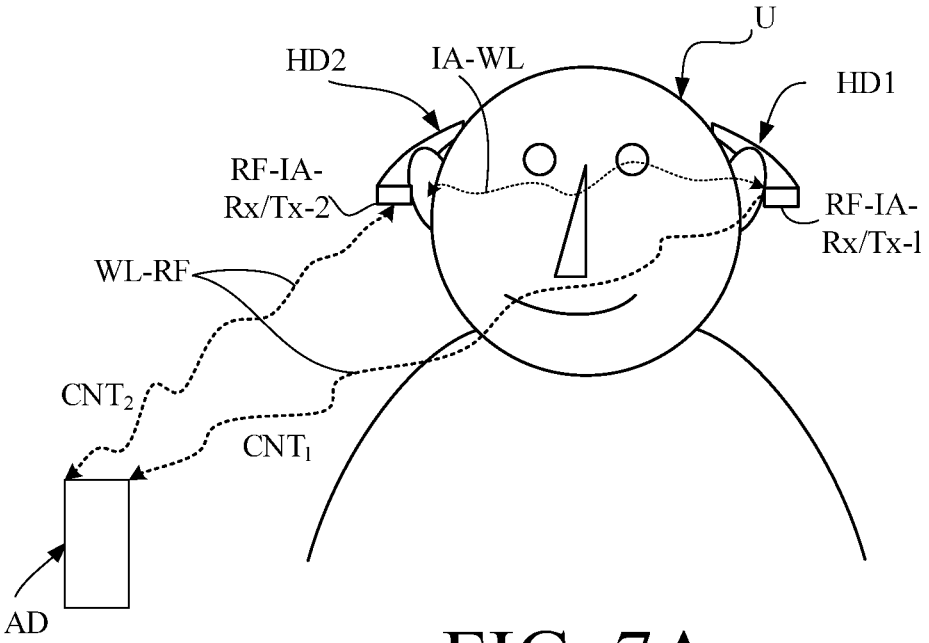
FIG. 7A shows an embodiment of a hearing system according to the present disclosure comprising left and right hearing devices in communication with an auxiliary device.
Figure 7B:
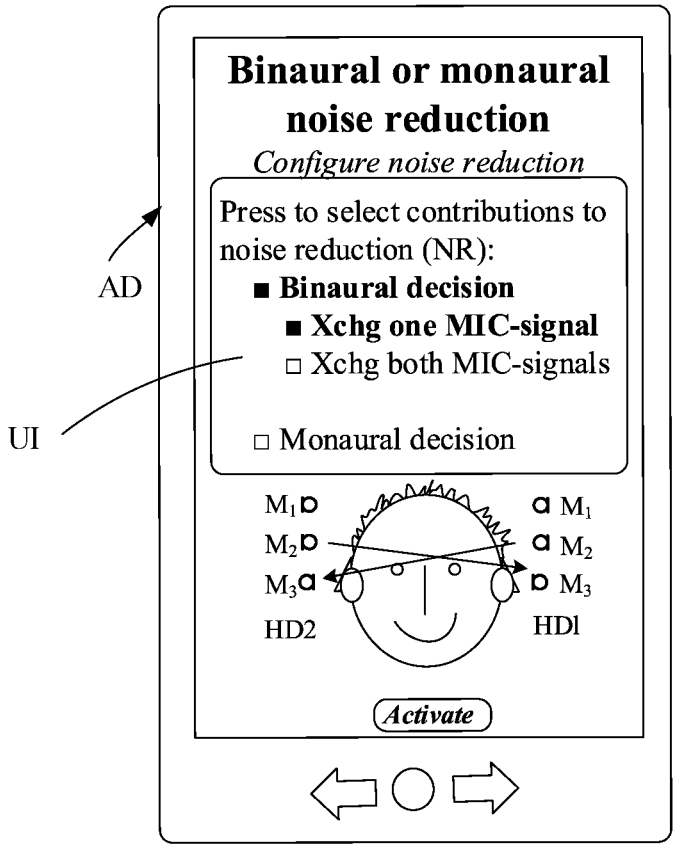
FIG. 7B shows the auxiliary device of FIG. 7A comprising a user interface of the hearing system, e.g. implementing a remote control for controlling functionality of the hearing system.

The hearing aid (HD) according to the present disclosure may comprise a user interface UI, e.g. as shown in FIG. 7B implemented in an auxiliary device (AD), e.g. a remote control, e.g. implemented as an APP in a smartphone or other portable (or stationary) electronic device.

FIG. 7A illustrates an embodiment of a hearing system according to the present disclosure. The hearing aid system comprises (first, HD1) left and (second, HD2) right hearing devices in communication with an auxiliary device (AD), e.g. a remote control device, e.g. a communication device, such as a cellular telephone or similar device capable of establishing a communication link to one or both of the left and right hearing devices.

FIG. 7A, 7B shows an application scenario comprising an embodiment of a hearing system, e.g. a binaural hearing aid system, comprising first and second hearing devices (HD1, HD2) and an auxiliary device (AD) according to the present disclosure. The auxiliary device (AD) comprises a cellular telephone, e.g. a SmartPhone. In the embodiment of FIG. 7A, the hearing devices and the auxiliary device are configured to establish wireless links (WL-RF) between them, e.g. in the form of digital transmission links according to the Bluetooth standard (e.g. Bluetooth Low Energy). The links may alternatively be implemented in any other convenient wireless and/or wired manner, and according to any appropriate modulation type or transmission standard, possibly different for different audio sources. The auxiliary device (e.g. a SmartPhone) of FIG. 7A, 7B comprises a user interface (UI) providing the function of a remote control of the hearing aid system, e.g. for changing program or operating parameters (e.g. volume) in the hearing device(s), etc. The user interface (UI) of FIG. 7B illustrates an APP (denoted 'Binaural or monaural noise reduction. Configure noise reduction') for selecting a mode of operation of the hearing system. The APP allows a user to select a binaural (Binaural decision) or monaural (Monaural decision) mode of operation of the noise reduction (NR) system. In the screen of FIG. 7B, the binaural mode of operation has been selected as indicated by the left solid 'tick-box' and the bold face indication Binaural decision. In this mode, one (Xchg one MIC signal) or both (Xchg both MIC signals) microphone signals can be selected to be exchanged between the first and second hearing devices HD1, HD2. In the screen of FIG. 7B, exchange of one of the microphone signals in the binaural mode of operation has been selected as indicated by the left solid 'tick-box' and the bold face indication Xchg one MIC signal. This is illustrated in the lower sketch of the user wearing left and right hearing devices (HD1, HD2) by the single arrows crossing the head of the user and the indication of active microphones M1, M2, M3 at each of the hearing devices (HD1, HD2).

The hearing device (HD1, HD2) are shown in FIG. 7A as devices mounted at the ear (behind the ear) of a user U. Other styles may be used, e.g. located completely in the ear (e.g. in the ear canal), fully or partly implanted in the head, etc. Each of the hearing devices comprise a wireless transceiver to establish an interaural wireless link (IA-WL) between the hearing devices, here e.g. based on inductive communication, and configured to allow the exchange of audio signals (based on frequency channels as proposed in the present disclosure). Each of the hearing devices further comprises a transceiver for establishing a wireless link (WL-RF, e.g. based on radiated fields (RF)) to the auxiliary device (AD), at least for receiving and/or transmitting signals ($CNT_1$, $CNT_2$), e.g. control signals, e.g. information signals, e.g. including audio signals. The transceivers are indicated by RF-IA-Rx/Tx-1 and RF-IA-Rx/Tx-2 in the left and right hearing devices (HD1, HD2), respectively.

Figure 8:
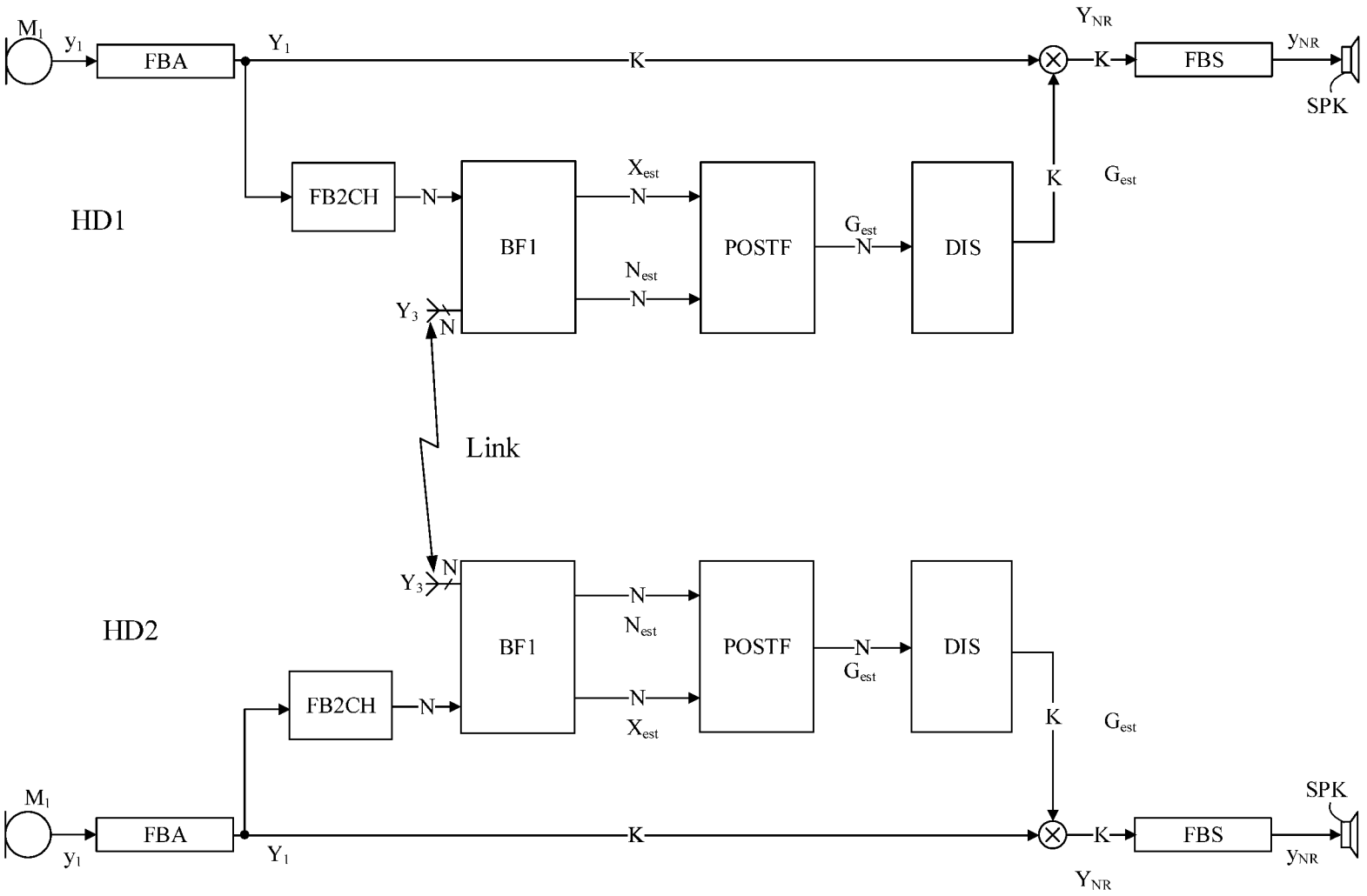
FIG. 8 shows an embodiment of a binaural hearing system comprising first and second hearing devices according to the present disclosure each hearing device comprising only a single microphone.

FIG. 8 shows an embodiment of a binaural hearing system comprising first and second hearing devices according to the present disclosure each hearing device comprising only a single microphone. The embodiment of a hearing system of FIG. 8 is similar to the embodiment of FIG. 1, but comprises only one input transducer (microphone) and thus the forward path from input transducer (microphone, $M_1$) to output transducer (loudspeaker, SPK) only comprises one electric input signal and thus no (second) beamformer filtering unit (BF2 in FIG. 1). Hence the signal to which the post filter gains $G_{est}$ are applied is the electric input signal $Y_1$ (in K frequency bands). Likewise, the first beamformer filtering unit (BF1) receives as inputs only the one electric input signal $Y_1$ in N channels and the further electric signal $Y_3$ from the opposite hearing device (instead of two electric inputs $Y_1$, $Y_2$ and further electric signal $Y_3$ in FIG. 1). Otherwise the system of FIG. 8 comprises the same functional elements as described in connection with FIG. 1 to provide a noise reduced signal $Y_{NR}$ in K frequency bands using beamformers ($N_{est}$, $X_{est}$) in N channels according to the present disclosure (where N<K).

Figure 9:
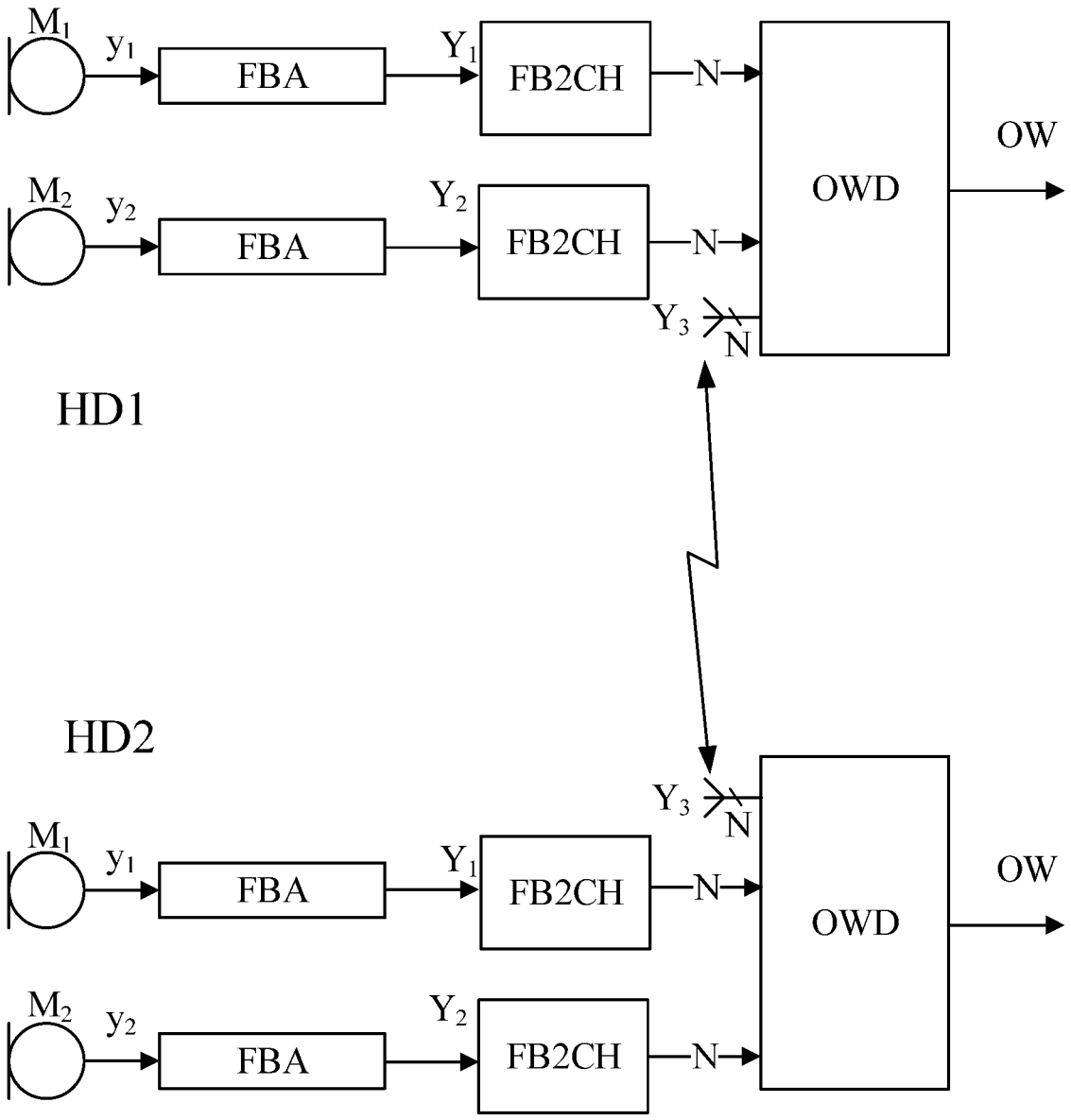
FIG. 9 shows an embodiment of a binaural hearing system comprising first and second hearing devices according to the present disclosure configured to detect a user's own voice.

FIG. 9 shows an embodiment of a binaural hearing system, e.g. a binaural own voice detector, comprising first and second hearing devices (e.g. ear pieces) according to the present disclosure configured to detect a user's own voice. Each hearing device (HD1, HD2) of the binaural hearing system is configured to estimate the presence of the user's own voice at a specific point in time based on at least one electric input signal in a number N of frequency channels and on at least one further electric signal in N frequency channels received from the opposite hearing device via a wireless link. Each of the first and second hearing devices HD1 and HD2 comprises two input transducers (microphones M1, M2) each providing respective time domain signals ($y_1$, $y_2$). Each microphone path comprises an analysis filter bank (FBA) for converting the time domain signals ($y_1$, $y_2$) into K different (possibly complex) frequency bands (signals $Y_1$ and $Y_2$ respectively). The K frequency bands are converted into a fewer number of N channels (see also FIG. 2) by respective frequency band to channel conversion units (FB2CH) providing the respective electric input signals $Y_1$ and $Y_2$ in N frequency channels. Having the K frequency bands represented by a fewer number of N frequency channels requires less bits for binaural transmission (cf. wireless link (Link)) compared to transmitting a signal based a full frequency band representation. A third microphone signal ($Y_3$) in N channels (wirelessly received from the opposite hearing device) is—together with the local microphone signals ($Y_1$, $Y_2$) in N channels—fed to own voice detector (OVD) for extracting the user's own voice based on the three electric signals in channels. The own voice detector may comprise an own voice cancelling beamformer (and/or an own voice maintaining beamformer) based on the three electric signals in channels ($Y_1$, $Y_2$, $Y_3$). The own voice detector (OVD) provides signal OW indicative of a presence of the user's own voice in the current electric input signals (e.g. a probability of such presence). The user's own voice (OW) may be detected in dependence of a combination of both of the local microphone signals $Y_1$, $Y_2$, which have different distances to the mouth (and thus will experience different levels when a user's voice is active) and the 'binaural microphone signal' ($Y_3$), which approximately has the same distance to the mouth as one of the two local microphones (and thus should experience approximately the same level when the user's voice is active). The signals used for own voice detection (or for determining a direction of arrival) can easily be combined across frequency bands as well as down-sampled. In an embodiment, the respective own voice detection signals (OW) are exchanged between the hearing devices and used to qualify the respective estimates.

In the embodiment of FIG. 9, each of the first and second hearing devices comprises two microphones ($M_1$, $M_2$) (as in the embodiment of FIG. 1), but might alternatively comprise one (as in FIG. 8) or more than two microphones.

The binaural own voice detector of FIG. 9 may e.g. be combined with the binaural hearing system of FIG. 1, where the own voice detector represents an additional feature of the system. The own voice detection signal may e.g. be used to control a gain in the forward path of a hearing device (e.g. to lower gain when a user's own voice is detected). It may also be an alternative (or work in parallel with) to the noise reduction system (including post filter (POSTF) and channel distribution unit (DIS)), or represent a feature of a specific own voice mode, where the user's own voice is picked up (and 'noise' (represented by other sounds) is suppressed by the channel beamformer (e.g. comprising an own voice cancelling beamformer). The user's own voice may in such mode e.g. be picked up and transmitted to another device, e.g. to a telephone (cf. e.g. EP3160162A1)

Figure 10:
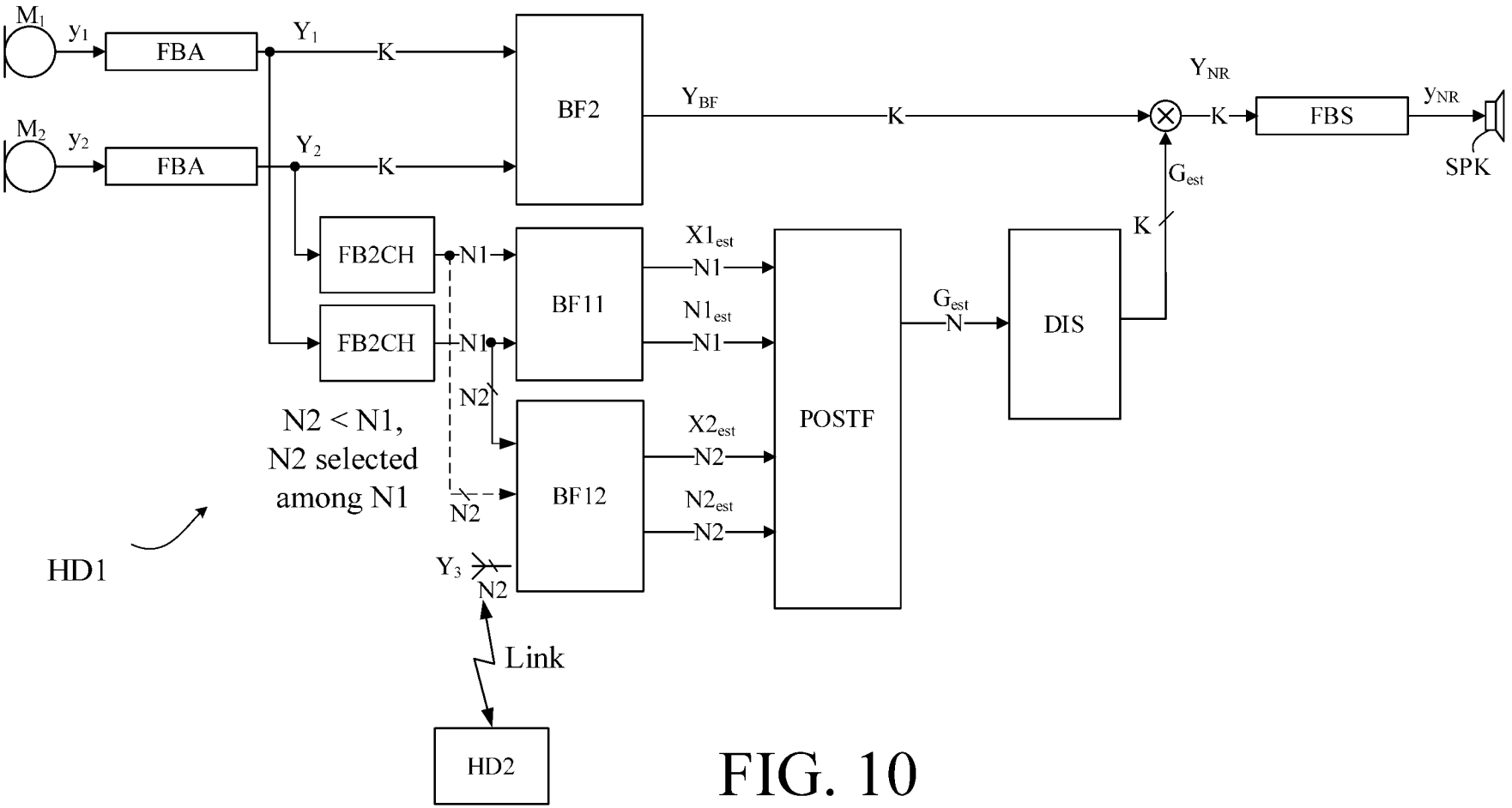
FIG. 10 shows an embodiment of a binaural hearing system comprising first and second hearing devices according to the present disclosure, each hearing device comprising two first beamformer filtering units, each for providing at least one channel beamformer, one being based on a multitude of local electric input signals in a number N1 of frequency channels, the other being based on at least one local electric input signal and at least one electric input signal received from the opposite hearing device in a number N2 of frequency channels, where the N2 frequency channels are a subset of the N1 frequency channels (i.e. N2<N1).

FIG. 10 shows an embodiment of a binaural hearing system comprising first and second hearing devices (HD1, HD2) according to the present disclosure. The embodiment of FIG. resembles the embodiment of FIG. 1. The differences are described in the following. Only HD1 (termed 'the local hearing device' in the following) is shown in detail in FIG. 10, but HD2 is assumed to be a mirror image of HD1, at least at the functional level shown for HD1. Each of the first and second hearing devices (HD1, HD2) comprises two first beamformer filtering units (BF11, BF12) each beamformer filtering unit (BF1i, i=1, 2) being configured to provide at least one channel beamformer (here two are provided, one intended to include a target signal ($Xi_{est}$), the other intended to exclude the target signal ($Ni_{est}$), i=1, 2). The first one (BF11) of the first beamformer filtering units is based on a multitude of local electric input signals (here two ($Y_1$, $Y_2$) from hearing device HD1) in a number N1 of frequency channels (N1<K). The second one (BF12) of the first beamformer filtering units is based on at least one local electric input signal (from hearing device HD1) in a number N2 of frequency channels (N2<N1<K), (here two are shown ($Y_1$, $Y_2$), one ($Y_2$) being indicated in dashed line, indicating its optional character) and at least one electric input signal also in N2 frequency channels (here one ($Y_3$) is shown) received from the opposite hearing device (here HD2). The N2 frequency channels represent a subset of the N1 frequency channels (i.e. N2<N1<K). The N2 frequency channels may e.g. be representative of the low frequency region of the human audible frequency range, e.g. below 4 kHz, such as below 3 kHz, such as below 2 kHz, or even below 1 kHz.

In the embodiment of FIG. 10, only some of the frequency bands (N2<N1) are transmitted to the other device so that a local beamformer having N1 frequency bands (N1<K) as well as a binaural beamformer having N2<N1 frequency bands are used to determine the postfilter gains. Thereby power and/or link bandwidth can be saved, which is important for miniature devices, like hearing aids, having limited space and hence battery capacity.

The present embodiment has the advantage of providing a functionally working fall-back configuration (as regards the noise reduction system) in case the (inter-aural) link is not enabled or otherwise not functioning to provide an acceptable link quality. In such case the postfilter (POSTF), e.g. based on a link quality measure for the wireless link (LINK), is configured to neglect the inputs ($X2_{est}$, $N2_{est}$) from the second one (BF12) of the first beamformers and only determine postfilter gains $G_{est}$ based on inputs ($X1_{est}$, $N1_{est}$) from the first one (BF11), thereby relying solely on the local electric input signals ($Y_1$, $Y_2$).

In an embodiment, the first and second hearing device (HD1, HD2) are assumed to exchange at least one microphone signal in N (here N2) frequency bands (N (N2)<K). In the embodiment of FIG. 10, the first hearing device (HD1) is configured to transmit at least one microphone signal (e.g. $Y_1$) in N2 frequency bands to the second hearing device (HD2), where it is processed in a manner equivalent to the one described above for the first hearing device (HD1) to provide postfilter gains ($G_{est}$) based on local and binaural beamformers, and to apply the postfilter gains to a signal of the forward path of the second hearing device to provide a noise reduced signal ($Y_{NR}$) in a number K of frequency bands for further processing (e.g. compression (compressive amplification)) and/or presentation to a user via an output unit, e.g. a loudspeaker. Thereby a binaural hearing system, e.g. a binaural hearing aid system, can be implemented. In an embodiment, postfilter gains are only determined in one of the first and second hearing devices and then transmitted to the other hearing device (e.g. instead of the microphone signal) for application to a signal of the forward path, thereby saving processing and transmission power (at least in one of the hearing devices). In an embodiment, the binaural hearing system may be configured to switch the task of determining the postfilter gains (as indicated above, and possibly other tasks) between them (from the first to the second hearing device or vice versa, one being e.g. then a master device, the other a slave device), e.g. according to a predefined scheme, e.g. with predefined time intervals, or in dependence of their battery capacity (cf. e.g. U.S. Pat. No. 9,924,281B2), and/or configured via a user interface).

It is intended that the structural features of the devices described above, either in the detailed description and/or in the claims, may be combined with steps of the method, when appropriately substituted by a corresponding process.

As used, the singular forms "a," "an," and "the" are intended to include the plural forms as well (i.e. to have the meaning "at least one"), unless expressly stated otherwise. It will be further understood that the terms "includes," "comprises," "including," and/or "comprising," when used in this specification, specify the presence of stated features, integers, steps, operations, elements, and/or components, but do not preclude the presence or addition of one or more other features, integers, steps, operations, elements, components, and/or groups thereof. It will also be understood that when an element is referred to as being "connected" or "coupled" to another element, it can be directly connected or coupled to the other element but an intervening elements may also be present, unless expressly stated otherwise. Furthermore, "connected" or "coupled" as used herein may include wirelessly connected or coupled. As used herein, the term "and/or" includes any and all combinations of one or more of the associated listed items. The steps of any disclosed method is not limited to the exact order stated herein, unless expressly stated otherwise.

It should be appreciated that reference throughout this specification to "one embodiment" or "an embodiment" or "an aspect" or features included as "may" means that a particular feature, structure or characteristic described in connection with the embodiment is included in at least one embodiment of the disclosure. Furthermore, the particular features, structures or characteristics may be combined as suitable in one or more embodiments of the disclosure. The previous description is provided to enable any person skilled in the art to practice the various aspects described herein. Various modifications to these aspects will be readily apparent to those skilled in the art, and the generic principles defined herein may be applied to other aspects.

The claims are not intended to be limited to the aspects shown herein, but is to be accorded the full scope consistent with the language of the claims, wherein reference to an element in the singular is not intended to mean "one and only one" unless specifically so stated, but rather "one or more." Unless specifically stated otherwise, the term "some" refers to one or more.

Accordingly, the scope should be judged in terms of the claims that follow.

REFERENCES

U.S. Pat. No. 8,204,263 (Oticon) Jun. 19, 2012
EP3229490A1 (Oticon) Oct. 11, 2017
EP3116239A1 (Oticon) Jan. 11, 2017
EP3255634A1 (Oticon) Dec. 13, 2017
EP3160162A1 (Oticon) Apr. 26, 2017
US9924281B2 (Oticon) Sep. 28, 2017

The invention claimed is:

1. A hearing device adapted for being located at or in an ear of a user, or for being fully or partially implanted in the head of the user, the hearing device comprising:

an input providing at least one electric input signal representing sound in the environment of the user wearing the hearing device in a frequency sub-band representation comprising a number K of frequency bands, a frequency band to channel allocation unit for allocating said number K of frequency bands to a number N of frequency channels for said at least one electric input signal, wherein the number K of frequency bands is larger than the number N of frequency channels;

antenna and transceiver circuitry allowing to receive at least one further electric signal representing sound in the environment of the user wearing the hearing device in said number N of frequency channels from another device;

a first beamformer filter providing at least one channel beamformer signal based on said at least one electric input signal in said number N of frequency channels and said at least one further electric signal received from said other device in said number N of frequency channels;

a level to gain transformation unit receiving said at least one channel beamformer signal and providing a post filter gain for each frequency channel in dependence of said channel beamformer signal;

a channel to band distribution unit distributing said post filter gains for each of said N channels to post filter gains for each of said K frequency bands; and a processor configured to apply said post filter gains for each of said K frequency bands to said at least one electric input signal, or a signal originating therefrom, and providing a noise reduced signal in K frequency bands, wherein the antenna and transceiver circuitry is configured to transmit at least one of said at least one electric input signal, or a processed version thereof, in said number of frequency channels to said other device from which the further electric signal is received, wherein the at least one channel beamformer signal is a target cancelling beamformer representing noise signal components of the at least one electric input signal, and wherein the another device is constituted by or comprises a hearing device.

2. The hearing device according to claim 1 wherein the first beamformer filter comprises first and second channel beamformers based on said at least one electric input signal in said number N of frequency channels and at least one further signal in said number N of frequency channels received from said other device.

3. The hearing device according to claim 1 wherein the input unit is configured to provide at least two electric input signals representing sound in the environment of the user wearing the hearing device in a frequency sub-band representation comprising said number K of frequency bands, and the hearing device further comprises a second beamformer filter for receiving said at least two electric input signals in said number K of frequency bands and providing a beamformed signal in said number K of frequency bands.

4. The hearing device according to claim 1 wherein the frequency band to channel allocation unit comprises a number of band combination units, each configured to provide a combination of the contents of two or more of said K frequency bands and to provide a respective one of said N frequency channels.

5. The hearing device according to claim 1 wherein the frequency band to channel allocation unit comprises a number of down-sampling units, each configured to down-sample a signal of a given channel with a down-sampling factor and to provide a corresponding down-sampled channel signal.

6. The hearing device according to claim 1 comprising a filter bank.

7. The hearing device according to claim 1 wherein the level to gain transformation unit comprises a signal quality estimator for estimating a signal quality measure in dependence of target and noise signal components at a given point in time.

8. The hearing device according to claim 7 wherein the level to gain transformation unit is configured to provide said post filter gain values for each frequency channel in dependence of said signal quality measure.

9. The hearing device according to claim 1 comprising an own voice detector configured to estimate the presence of the user's own voice at a specific point in time based on said at least one electric input signal in said number N of frequency channels and said at least one further signal in said number N of frequency channels received from said other device.

10. The hearing device according to claim 1 comprising an output unit for providing a stimulus perceived by the user as an acoustic signal based on a processed electric signal.

11. The hearing device according to claim 1 being constituted by or comprising a hearing aid, a headset, an earphone, an ear protection device or a combination thereof.

12. The hearing device according to claim 1 wherein said other device is constituted by or comprises a hearing device or a separate processing device.

13. The hearing system comprising first and second hearing devices each according to claim 1, the first and second hearing devices constituting or forming part of a binaural hearing system.

14. A hearing device adapted for being located at or in an ear of a user, or for being fully or partially implanted in the head of the user, the hearing device comprising:

an input providing at least two electric input signals representing sound in the environment of the user wearing the hearing device in a frequency sub-band representation comprising a number K of frequency bands;

at least two frequency band to channel allocation units allocating said number K of frequency bands to a number N1 of frequency channels for said at least two electric input signal, wherein the number K of frequency bands is larger than the number N1 of frequency channels;

antenna and transceiver circuitry allowing to receive at least one further electric signal representing sound in the environment of the user wearing the hearing device in said number N of frequency channels from another device; and at least two first beamformer filter, a first one for providing at least one local channel beamformer based on said at least two electric input signals in said number N1 of frequency channels, and a second one for providing at least one binaural channel beamformer based on at least one of said at least two electric input signals in a number N2 of said number N1 of frequency channels, where N2 is smaller than or equal to N1, and on said at least one further electric signal received from said other device in said number N2 of frequency channels.

15. The hearing device according to claim 14 further comprising:

a level to gain transformation unit for receiving said at least one channel beamformer signal and providing a post filter gain for each frequency channel in dependence of said channel beamformer signal, wherein said level to gain transformation unit is configured to receive for receiving said at least one local channel beamformer signal and said at least one binaural channel beamformer signal and providing said post filter gain for each frequency channel in dependence of said local and binaural channel beamformer signals.

16. The hearing device according to claim 15 wherein the level to gain transformation unit is configured to provide said post filter gain for each frequency channel in dependence of said local channel beamformer, while neglecting the binaural channel beamformer, in a specific local mode of operation of the hearing device.

17. A method of operating a hearing device adapted for being located at or in an ear of a user, or for being fully or partially implanted in the head of the user, the method comprising providing at least one electric input signal representing sound in the environment of the user wearing the hearing device in a frequency sub-band representation comprising a number K of frequency bands, allocating said number K of frequency bands to a number N of frequency channels for said at least one electric input signal, wherein the number K of frequency bands is larger than the number N of frequency channels;

receiving at least one further electric signal representing sound in the environment of the user wearing the hearing device in said number N of frequency channels from another device;

providing at least one channel beamformer signal based on said at least one electric input signal in said number N of frequency channels and said at least one further electric signal received from said other device in said number N of frequency channels;

providing a post filter gain for each frequency channel in dependence of said channel beamformer signal;

distributing said post filter gains for each of said N channels to post filter gains for each of said K frequency bands;

applying said post filter gains for each of said K frequency bands to said at least one electric input signal, or a signal originating therefrom, and providing a noise reduced signal in K frequency bands; and transmitting at least one of said at least one electric input signal, or a processed version thereof, in said number of frequency channels to said other device from which the further electric signal is received, wherein the at least one channel beamformer signal is a target cancelling beamformer representing noise signal components of the at least one electric input signal, and wherein the another device is constituted by or comprises a hearing device.

* * * * *